US009354589B2

(12) United States Patent
Sugiura et al.

(10) Patent No.: US 9,354,589 B2
(45) Date of Patent: May 31, 2016

(54) CLEANER, IMAGE FORMING APPARATUS USING THE CLEANER, AND VOLTAGE SETTING DEVICE

(71) Applicants: Kenji Sugiura, Kanagawa (JP); Seiichi Kogure, Kanagawa (JP); Junpei Fujita, Kanagawa (JP); Junichi Ichikawa, Kanagawa (JP); Kazuki Yogosawa, Tokyo (JP)

(72) Inventors: Kenji Sugiura, Kanagawa (JP); Seiichi Kogure, Kanagawa (JP); Junpei Fujita, Kanagawa (JP); Junichi Ichikawa, Kanagawa (JP); Kazuki Yogosawa, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/255,306

(22) Filed: Apr. 17, 2014

(65) Prior Publication Data

US 2014/0321874 A1 Oct. 30, 2014

(30) Foreign Application Priority Data

Apr. 30, 2013 (JP) ..... 2013-095745

(51) Int. Cl.

*G03G 15/00* (2006.01)
*G03G 21/00* (2006.01)
*G03G 15/16* (2006.01)

(52) U.S. Cl.

CPC ..... *G03G 21/0035* (2013.01); *G03G 15/161* (2013.01); *G03G 15/168* (2013.01); *G03G 2215/0141* (2013.01); *G03G 2215/1661* (2013.01)

(58) Field of Classification Search

CPC ..... G03G 15/161; G03G 15/0863; G03G 15/1645; G03G 15/0921; G03G 21/00; G03G 21/0035; G03G 21/10; G03G 2215/1661

USPC ..... 399/66, 71, 174, 175

See application file for complete search history.

(56) References Cited

U.S. PATENT DOCUMENTS 9,235,165 B2 * 1/2016 Makino ..... G03G 15/1675
2007/0019989 A1 * 1/2007 Nakamori ..... 399/159

(Continued)

FOREIGN PATENT DOCUMENTS

JP 2005-316268 11/2005
JP 2006-119305 5/2006

(Continued)

*Primary Examiner* — Walter L Lindsay, Jr.
*Assistant Examiner* — Jessica L Eley
(74) *Attorney, Agent, or Firm* — Oblon, McClelland, Maier & Neustadt, L.L.P.

(57) ABSTRACT

A cleaner is provided. The cleaner includes at least two cleaning brush members to electrostatically remove residual toner on an object; a memory; a voltage applicator to apply a voltage to the cleaning brush members based on the setup voltage values stored in the memory; a current detector to detect the amounts of currents flowing through contact portions of the object with the cleaning brush members; and a setup voltage changing device to change the setup voltage values based on the amounts of currents detected by the current detector. The setup voltage changing device performs change of the setup voltage values for the cleaning brush members at a time.

5 Claims, 13 Drawing Sheets

(56) References Cited

U.S. PATENT DOCUMENTS

| | | | | |
|---|---|---|---|---|
| 2007/0230993 | A1* | 10/2007 | Takeuchi | 399/101 |
| 2011/0103822 | A1* | 5/2011 | Sugiura et al. | 399/101 |
| 2011/0158677 | A1 | 6/2011 | Kikuchi et al. | |
| 2011/0229187 | A1 | 9/2011 | Hozumi et al. | |
| 2011/0229234 | A1 | 9/2011 | Hozumi et al. | |
| 2012/0008973 | A1 | 1/2012 | Sakakibara et al. | |
| 2012/0034006 | A1 | 2/2012 | Asaoka et al. | |
| 2012/0087704 | A1 | 4/2012 | Asaoka et al. | |
| 2012/0099883 | A1* | 4/2012 | Kikuchi et al. | 399/71 |
| 2012/0224870 | A1* | 9/2012 | Kikuchi et al. | 399/44 |
| 2013/0315617 | A1 | 11/2013 | Sugiura et al. | |
| 2014/0064769 | A1* | 3/2014 | Sugiura | G03G 21/0035 399/71 |

FOREIGN PATENT DOCUMENTS

| | | |
|---|---|---|
| JP | 2011-133664 | 7/2011 |
| JP | 2012-185288 | 9/2012 |

* cited by examiner

CLEANER, IMAGE FORMING APPARATUS USING THE CLEANER, AND VOLTAGE SETTING DEVICE

CROSS-REFERENCE TO RELATED APPLICATIONS

This patent application is based on and claims priority pursuant to 35 U.S.C. §119 to Japanese Patent Application No. 2013-095745 filed on Apr. 30, 2013 in the Japan Patent Office, the entire disclosure of which is hereby incorporated by reference herein.

TECHNICAL FIELD

This disclosure relates to a cleaner for use in image forming apparatuses such as printers, facsimiles and copiers. In addition, this disclosure relates to an image forming apparatus using the cleaner, and to a voltage setting device.

BACKGROUND

Conventionally, tandem color image forming apparatuses in which different color toner images are formed by linearly arranged plural image forming sections, and the color toner images are transferred one by one onto an intermediate transfer medium, which is fed along the image forming sections, to form a combined color toner image on the intermediate transfer medium, have been used for producing multiple color images at a high speed. In each of the image forming sections of such tandem color image forming apparatuses, an electrostatic latent image formed on a photoreceptor serving as an image bearing member is developed by a developing device using a color toner to form a color toner image on the photoreceptor. The different color toner images thus formed on the photoreceptors of the image forming sections are transferred one by one onto the intermediate transfer medium so as to be overlaid to form a combined color toner image on the intermediate transfer medium, and the combined color toner image is transferred onto a recording medium such as paper sheets, resulting in formation of a multi-color image.

In order to remove residual toner remaining on the intermediate transfer medium even after the combined color toner image is transferred, cleaners to remove residual toner using an electrostatic force have been proposed.

For example, JP-4684617-B1 (i.e., JP-2006-119305-A) proposes a cleaner which electrostatically removes normally-charged residual toner, which is present on an intermediate transfer belt and which is charged normally (i.e., which has a charge with the same polarity as that of the toner used), and reversely-charged residual toner, which is also present on the intermediate transfer belt and which is charged reversely.

This cleaner includes a first cleaning brush roller to remove normally-charged residual toner from the intermediate transfer belt, and a second cleaning brush roller to remove reversely-charged residual toner from the intermediate transfer belt.

In addition, the cleaner includes a first counter roller, which is grounded and which is arranged so as to be contacted with the backside of the intermediate transfer belt while facing the first cleaning brush roller with the intermediate transfer belt therebetween, and a second counter roller, which is grounded and which is arranged so as to be contacted with the backside of the intermediate transfer belt while facing the second cleaning brush roller with the intermediate transfer belt therebetween.

A voltage having a polarity opposite to that of the normally-charged toner is applied to the first cleaning brush roller by a power source. In this case, a potential difference is formed between the first cleaning brush roller and the first counter roller, thereby forming an electric field such that the normally-charged residual toner on the intermediate transfer belt is electrostatically attracted by the first cleaning brush roller.

In addition, a voltage having the same polarity as that of the normally-charged toner is applied to the second cleaning brush roller by a power source. In this case, a potential difference is formed between the second cleaning brush roller and the second counter roller, thereby forming an electric field such that the reversely-charged residual toner on the intermediate transfer belt is electrostatically attracted by the second cleaning brush roller.

Thus, the normally-charged residual toner on the intermediate transfer belt is electrostatically attracted by the first cleaning brush roller, and therefore the residual toner is removed from the intermediate transfer belt. In addition, the reversely-charged residual toner on the intermediate transfer belt is electrostatically attracted by the second cleaning brush roller, and therefore the residual toner is also removed from the intermediate transfer belt.

In addition, the voltage applied to the cleaning brush roller is adjusted depending on the conditions of use. Specifically, the resistances of the intermediate transfer belt and the cleaning brush roller are typically predetermined. However, the resistances tend to vary due to variation of initial resistances of such members or when the members are used for a long period of time. When the resistance of the intermediate transfer belt or the cleaning brush roller falls out of the predetermined range and cleaning is performed under the normal conditions (i.e., at the predetermined voltage), defective cleaning is often caused.

The electrostatic cleaning performance of a cleaning brush roller highly correlates with the amount of the current flowing through the contact portion of the cleaning brush roller and the intermediate transfer belt. If the amount of the current can be maintained so as to fall in the targeted range, it is possible to maintain a high level of cleaning performance even when the resistances of the intermediate transfer belt and the cleaning brush roller vary.

In the image forming apparatus disclosed by JP-4684617-B1 (i.e., JP-2006-119305-A), the amount of the current flowing through the contact portion of the cleaning brush roller and the intermediate transfer belt is detected, and the setup voltage value stored in a memory is properly changed so that the targeted current flows through the contact portion of the cleaning roller and the intermediate transfer belt. It is described therein that occurrence of defective cleaning can be prevented because a voltage suitable for cleaning is applied to the cleaning brush roller even when the resistances of the intermediate transfer belt and the cleaning brush roller vary.

SUMMARY

As an aspect of the present invention, a cleaner is provided which includes at least two cleaning brush members to electrostatically remove residual toner (such as toner particles remaining on an object even after the transferring process, and a non-transferred toner image (such as a toner test pattern)) from the surface of an object to be cleaned; a memory to store setup voltage values; a voltage applicator to apply voltages to the cleaning brush members based on the setup voltage values stored in the memory; a current detector to detect the amounts of currents flowing through the contact portions of the object with the cleaning brush members; and a setup voltage changing device to change the setup voltage values based on the amounts of currents detected by the current detector. The setup voltage changing device changes the setup voltage values for all the cleaning brush members at the same time.

As another aspect of the present invention, an image forming apparatus is provided which includes an image bearing member; a toner image forming device to form a toner image on the image bearing member; a primary transferring device to transfer the toner image on the image bearing member to an intermediate transfer medium; a secondary transferring device to transfer the toner image on the intermediate transfer medium to a recording medium; and the above-mentioned cleaner to remove residual toner from the surface of the intermediate transfer medium.

In addition, an image forming apparatus is provided which includes an image bearing member; a toner image forming device; a transferring device to transfer the toner image to a recording medium at a transfer position; a recording medium feeding member to feed the recording medium to the transfer position; and the above-mentioned cleaner to remove residual toner from the surface of the recording medium feeding member.

Further, an image forming apparatus is provided which includes at least an image bearing member; a toner image forming device; and the above-mentioned cleaner to remove residual toner from the surface of the image bearing member.

As yet another aspect of the present invention, a voltage setting device is provided which includes at least two voltage applying members, which are contacted with different positions of an object (such as an image bearing member, an intermediate transfer medium, or a recording medium feeding member) and to which voltages are applied based on setup voltage values stored in a memory; a current detector to detect the amounts of currents flowing through the contact portions of the voltage applying members with the object; and a setup voltage changing device to change the setup voltage values based on the amounts of currents detected by the current detector. The setup voltage changing device changes the setup voltage values for all the voltage applying members at the same time.

The aforementioned and other aspects, features and advantages will become apparent upon consideration of the following description of the preferred embodiments taken in conjunction with the accompanying drawings.

DETAILED DESCRIPTION

In the image forming apparatus disclosed by JP-4684617-B1 (i.e., JP-2006-119305-A) mentioned above, change of setting of the setup voltage is performed on each of the two cleaning brush rollers one by one. Therefore, it takes time until change of setting of the setup voltage of all the cleaning brush rollers is completed, resulting in prolongation of downtime in which the image forming operation cannot be performed.

The objective of this disclosure is to provide a cleaner in which change of setting of the setup voltage for all the cleaning brush rollers can be completed in a relatively short time.

Hereinafter, a tandem type printer using an intermediate transfer method (hereinafter referred to as a printer) as an example of an image forming apparatus according to an embodiment will be described. Initially, the basic configuration of the printer will be described by reference to drawings.

Figure 2:
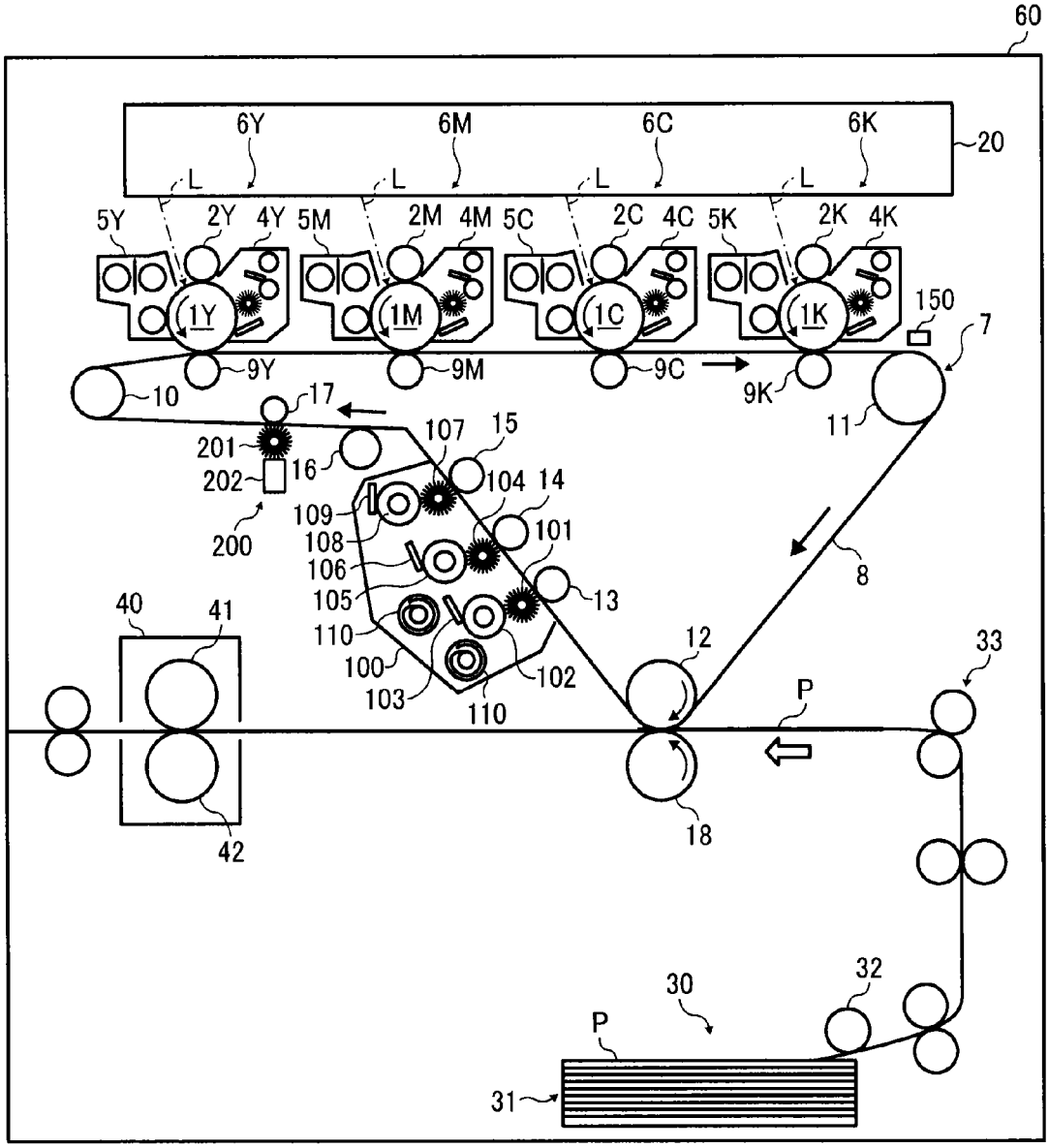
FIG. 2 is a schematic view illustrating a printer as an image forming apparatus according to an embodiment

FIG. 2 is a schematic view illustrating a main portion of a printer 60. The printer 60 includes four process units 6Y, 6M, 6C and 6K, which serve as toner image forming devices and which respectively form yellow (Y), magenta (M), cyan (C) and black (K) toner images.

The process units 6Y, 6M, 6C and 6K respectively include drum-shaped photoreceptors 1Y, 1M, 1C and 1K. Around the photoreceptors 1Y, 1M, 1C and 1K, chargers 2Y, 2M, 2C and 2K, developing devices 5Y, 5M, 5C and 5K, drum cleaners 4Y, 4M, 4C and 4K, and dischargers (not shown) are respectively arranged. The process units 6Y, 6M, 6C and 6K have the same configuration except that different color toners, i.e., Y, M, C and K toners, are used therefor.

An optical writing unit 20, which irradiates the photoreceptors 1 with laser light L to form electrostatic latent images thereon, is provided above the process units 6.

In this printer 60, the chargers 2, the developing devices 5 and the optical writing unit 20 serve as a toner image forming device.

A transfer unit 7 including an intermediate transfer belt 8, which is a rotatable endless image bearing member, is provided below the process units 6. The transfer unit 7 further includes plural stretching rollers, which are arranged inside the loop of the intermediate transfer belt 8, and a secondary transfer roller 18, a tension roller 16, a belt cleaner 100, and a lubricant applicator 200, which are arranged outside the loop of the intermediate transfer belt.

Inside the loop of the intermediate transfer belt 8, four primary transfer rollers 9Y, 9M, 9C and 9K, a driven roller 10, a driving roller 11, a secondary transfer counter roller 12, and three cleaner counter rollers 13, 14 and 15, and a lubricant applicator counter roller 17 are arranged.

These rollers serve as stretching rollers to stretch the intermediate transfer belt 8. In this regard, the cleaner counter rollers 13, 14 and 15 do not necessarily apply a tension to the intermediate transfer belt 8, and may be driven by the rotated intermediate transfer belt.

The intermediate transfer belt 8 is rotated clockwise by the driving roller 11, which is rotated clockwise by a driving device (not shown).

The primary transfer rollers 9Y, 9M, 9C and 9K, which are arranged inside the loop of the intermediate transfer belt 8, and the photoreceptors 1Y, 1M, 1C and 1K sandwich the intermediate transfer belt 8, and therefore primary transfer nips for Y, M, C and K images are formed between the outer surface of the intermediate transfer belt 8 and the photoreceptors 1.

In this regard, primary transfer biases having a polarity opposite to that of charge of the toners are applied to the primary transfer rollers 9Y, 9M, 9C and 9K, respectively, by power sources (not shown).

The secondary transfer counter roller 12 arranged inside the loop of the intermediate transfer belt 8 and the secondary transfer roller 18 arranged outside the loop sandwich the intermediate transfer belt 8, thereby forming a secondary transfer nip between the outer surface of the intermediate transfer belt and the surface of the secondary transfer roller.

In this regard, a secondary transfer bias having a polarity opposite to that of charge of the toners is applied to the secondary transfer roller 18 by a power source (not shown). In addition, a recording medium feeding belt may be provided while supported by the secondary transfer roller 18, and several support rollers so that a recording medium P is fed by the feeding belt to the secondary transfer nip at which the intermediate transfer belt 8 and the feeding belt are sandwiched by the secondary transfer roller 18 and the secondary transfer counter roller 12.

The three cleaner counter rollers 13, 14 and 15, which are arranged inside the loop of the intermediate transfer belt 8, and cleaning brush rollers 101, 104 and 107 of the belt cleaner 100 sandwich the intermediate transfer belt 8, thereby forming cleaning nips therebetween.

The belt cleaner 100 and the intermediate transfer belt 8 are integrated so as to be replaced as a unit. However, if the belt cleaner 100 and the intermediate transfer belt 8 have different lives, it is possible for the belt cleaner 100 to be detachably attachable to the printer independently of the intermediate transfer belt 8. The belt cleaner 100 will be described later in detail.

The printer 60 further includes a recording medium feeder 30 including a recording medium cassette 31 to contain sheets of the recording medium P such as papers, and a feed roller 32 to feed the recording medium P to a sheet passage having several feed rollers to feed the recording medium P from the cassette toward the secondary transfer nip. In addition, the printer also includes a pair of registration rollers 33, which is arranged on the right side of the secondary transfer nip to feed the recording medium P fed from the cassette toward the secondary transfer nip at a predetermined time so that the toner image on the intermediate transfer belt 8 is transferred onto a proper position of the recording medium at the secondary transfer nip. Further, the printer includes a fixing device 40, which receives the recording medium P fed from the secondary transfer nip and which fixes the toner image to the recording medium P using a heat roller 41 and a pressure roller 42, on the left side of the secondary transfer nip. The printer optionally includes toner supplying devices to respectively supply the Y, M, C and K toners to the developing devices 5Y, 5M, 5C and 5K.

Recently, not only plain papers, but also papers having concaves and convexes on the surface thereof to modify the design thereof and recording papers used for thermal transferring (iron printing) have been used for image forming apparatuses. When such special papers are used as the recording medium P, defective image transferring is often caused when a toner image on the intermediate transfer belt 8 is transferred onto the special papers.

Therefore, in this printer 60, an elastic layer having a low hardness is formed on the intermediate transfer belt 8 so that when the intermediate transfer belt 8 is contacted with such a rough paper with the toner image therebetween, the intermediate transfer belt is easily deformed so that the surface of the intermediate transfer belt is contacted with the concaves of the rough paper.

Since such an elastic layer is formed, the toner image on the intermediate transfer belt 8 can be satisfactorily adhered to the surface of the rough paper without increasing the transfer pressure, thereby making it possible to evenly transfer the toner image onto the rough paper without causing defective transferring (such as uneven transferring of toner images, and formation of omissions in character images).

The intermediate transfer belt 8 of this printer includes at least a base layer, an elastic layer overlying the base layer, and an outermost coat layer overlying the elastic layer.

Suitable materials for use in the elastic layer of the intermediate transfer belt 8 include elastic rubbers and elastomers Specific examples of the material for use in the elastic layer include, but are not limited thereto, rubbers such as butyl rubbers, fluorine-containing rubbers, acrylic rubbers, EPDM (ethylene-propylene-diene rubbers), NBR (acrylonitrile-butadiene rubbers), acrylonitrile-butadiene-styrene rubbers, natural rubbers, isoprene rubbers, styrene-butadiene rubbers, butadiene rubbers, urethane rubbers, syndiotactic 1,2-polybutadiene, epichlorohydrin rubbers, polysulfide rubbers, and polynorbonene rubbers; and thermoplastic elastomers such as polystyrene, polyolefin, polyvinyl chloride, polyurethane, polyamide, polyurea, polyester, and fluorine-containing resins. These materials can be used alone or in combination.

The thickness of the elastic layer is determined depending on the hardness of the material and the layer structure, and is preferably from 0.07 mm to 0.8 mm, and more preferably from 0.25 mm to 0.5 mm. When the thickness is less than 0.07 mm, the pressure to the toner image on the intermediate transfer belt 8 seriously increases at the secondary transfer nip, thereby often causing the omission problem in that omissions are formed in the transferred toner image. In addition, the transfer rate of toner images tends to decrease.

The hardness (JIS-A hardness) of the elastic layer is preferably from 10 degree to 65 degree. The optimum hardness of the elastic layer changes depending on the thickness of the intermediate transfer belt 8, but when the JIS-A hardness is lower than 10 degree, the omission problem mentioned above tends to be caused. In contrast, when the JIS-A hardness is higher than 65 degree, it becomes difficult to stretch the intermediate transfer belt 8 with rollers. In addition, when the intermediate transfer belt 8 is tightly stretched for a long period of time, the belt tends to be extended, resulting in shortening of the life of the belt.

The base layer of the intermediate transfer belt 8 is preferably constituted of a resin having a small extension rate. Specific examples of the material for use in the base layer include, but are not limited thereto, polycarbonates, fluorine-containing resins (such as ETFE (ethylene-tetrafluoroethylene copolymers) and PVDF (polyvinylidene fluoride)), styrene resins (homopolymers and copolymers of styrene and styrene derivatives) such as polystyrenes, chlorinated polystyrenes, poly-α-methylstyrenes, styrene-butadiene copolymers, styrene-vinyl chloride copolymers, styrene-vinyl acetate copolymers, styrene-maleic acid copolymers, styrene-acrylate copolymers (such as styrene-methyl acrylate copolymers, styrene-ethyl acrylate copolymers, styrene-butyl acrylate copolymers, styrene-octyl acrylate copolymers, and styrene-phenyl acrylate copolymers), styrene-methacrylate copolymers (such as styrene-methyl methacrylate copolymers, styrene-ethyl methacrylate copolymers, and styrene-phenyl methacrylate copolymers), styrene-methyl α-chloroacryalte copolymers, and styrene-acrylonitrile-acrylate copolymers; methyl methacryalte resins, butyl methacrylate resins, ethyl acrylate resins, butyl acrylate resins, modified acrylic resins (such as silicone-modified acrylic resins, vinyl chloride-modified acrylic resins, and acrylic-urethane resins), vinyl chloride resins, styrene-vinyl acetate resins, vinyl chloride-vinyl acetate copolymers, rosin-modified maleic resins, phenolic resins, epoxy resins, polyester resins, polyester polyurethane resins, polyethylene resins, polypropylene resins, polybutadiene resins, polyvinylidene chloride resins, ionomer resins, polyurethane resins, silicone resins, ketone resins, ethylene-ethylacrylate copolymers, xylene resins, polyvinyl butyral resins, polyamide resins, and modified polyphenyleneoxide resins. These materials can be used alone or in combination.

In order to prevent extension of the elastic layer, which is typically constituted of a material such as rubber having a large extension rate, a core layer constituted of an extension preventing material such as fibers and cloth can be formed between the base layer and the elastic layer.

Specific examples of such an extension preventing material for use in the core layer include, but are not limited thereto, natural fibers such as cotton and silk; synthetic fibers such as polyester fibers, nylon fibers, acrylic fibers, polyolefin fibers, polyvinyl alcohol fibers, polyvinyl chloride fibers, polyvinylidene chloride fibers, polyurethane fibers, polyacetal fibers, polyfluoroethylene fibers, and phenolic fibers; inorganic fibers such as carbon fibers, and glass fibers; and metal fibers such as iron fibers, and copper fibers, and cloths produced by using these fibers. These materials can be used alone or in combination.

The yarn of the cloth is not particularly limited, and any known yarns such as yarn in which one or more filaments are twisted, single-twisted yarn, double-twisted yarn, and two-folded yarn can be used. These yarns can be used alone or in combination. In addition, the yarn can be subjected to an electroconductive treatment.

Any woven cloths such as stockinet can be used for the core layer. In addition, union cloths can also be used, and cloths subjected to an electroconductive treatment can be used.

The outermost coat layer of the intermediate transfer belt 8 is formed by coating to cover the elastic layer, and preferably has a smooth surface.

The material constituting the outermost coat layer is not particularly limited, but materials having low adhesiveness to toner are preferably used to enhance the secondary transferring property of the intermediate transfer belt 8.

For example, one or more of polyurethane resins, polyester resins, and epoxy resins can be used for the outermost coat layer. In addition, one or more of particulate materials having low surface energy while having good lubricity such as fluorine-containing resins, fluorine compounds, carbon fluoride, titanium oxide, and silicon carbide, can be dispersed in the outermost coat layer. If desired, particulate materials having different particle diameters can be dispersed in the outermost coat layer.

It is possible to form a layer of fluorine by subjecting a fluorine-containing rubber to a heat treatment so that the resultant outermost coat layer has low surface energy.

In order to adjust the resistance of the base layer, the elastic layer, and the outermost coat layer, electroconductive materials such as carbon black, graphite, powders of metals such as aluminum and nickel, and electroconductive metal oxides such as tin oxide, titanium oxide, antimony oxide, indium oxide, potassium titanate, antimony oxide-tin oxide complex oxides (ATO), indium oxide-tin oxide complex oxides (ITO) can be used.

In this regard, the metal oxides may be covered with a particulate insulating material such as barium sulfate, magnesium silicate, and calcium carbonate. The resistance adjusting material is not limited to these materials.

The surface of the intermediate transfer belt 8 is coated with a lubricant by the lubricant applicator 200 to protect the surface. The lubricant applicator 200 includes a solid lubricant 202 such as block of zinc stearate, and a brush roller 201 which is contacted with the solid lubricant 202 while rotated to scrape off the lubricant and which applies the lubricant to the surface of the intermediate transfer belt 8.

This printer 60 includes the lubricant applicator 200, but the image forming apparatus of this disclosure does not necessarily include such a lubricant applicator depending on choice of toner, choice of the material of the intermediate transfer belt, and the friction coefficient of the surface of the intermediate transfer belt 8.

Next, the image forming operation of the printer 60 will be described.

When image information is sent from a personal computer or the like, the printer rotates the driving roller 11 to rotate the intermediate transfer belt 8. In this regard, the stretching rollers other than the driving roller 11 are driven by the intermediate transfer belt 8. At the same time, the photoreceptors 1 of the process units 6 are rotated.

The surfaces of the photoreceptors 1 are charged by the respective chargers 2, and then irradiated with laser light L to form electrostatic latent images thereon. The electrostatic latent images thus formed on the photoreceptors 1 are developed by the developing devices 5 to form Y, M, C and K toner images on the photoreceptors.

The Y, M, C and K toner images are transferred onto the outer surface of the intermediate transfer belt 8 at the primary transfer nips (i.e., Y, M, C and K nips) so as to be overlaid, thereby forming a combined four color toner image on the outer surface of the intermediate transfer belt.

Meanwhile, sheets of the recording medium P are fed one by one from the recording medium cassette 31 toward the pair of registration rollers 33. The pair of registration rollers 33 is timely rotated so that the combined four color toner image on the intermediate transfer belt 8 is transferred onto a proper position of a sheet of the recording medium P at the secondary transfer nip.

Thus, a full color toner image is formed on the sheet of the recording medium P. The sheet of the recording medium P bearing the full color toner image thereon is fed to the fixing device 40 to fix the full color toner image, thereby forming a full color image.

In this printer 60, the conditions of contact of the photoreceptors 1 with the intermediate transfer belt 8 in a monochromatic mode are different from the conditions of contact of the photoreceptors with the intermediate transfer belt in a color mode.

Specifically, among the four primary transfer rollers 9Y, 9M, 9C and 9K of the transfer unit 7, the primary transfer roller 9K is supported by an exclusive bracket, which is not used for the other primary rollers.

The other primary transfer rollers 9Y, 9M and 9C are supported by a common moving bracket. This moving bracket is driven by a solenoid to move in such directions as to approach or leave from the photoreceptors 1Y, 1M and 1C.

When the moving bracket is moved so as to leave from the photoreceptors 1Y, 1M and 1C, the posture of the intermediate transfer belt 8 is changed in such a manner that the intermediate transfer belt is separated from the photoreceptors 1Y, 1M and 1C.

Even in this case, the photoreceptor 1K remains contacted with the intermediate transfer belt 8. When producing monochromatic images, the image forming operation is performed while only the photoreceptor 1K is contacted with the intermediate transfer belt 8.

When the moving bracket is moved so as to approach the photoreceptors 1Y, 1M and 1C, the posture of the intermediate transfer belt 8 is changed in such a manner that the intermediate transfer belt, which is separated from the three photoreceptors 1Y, 1M and 1C, is contacted with the photoreceptors.

In this case, the photoreceptor 1K remains contacted with the intermediate transfer belt 8. When producing color images, the image forming operation is performed while all the photoreceptors 1Y, 1M, 1C and 1K are contacted with the intermediate transfer belt 8.

In this case, the moving bracket and the solenoid mentioned above serve as an attaching/detaching device by which the photoreceptors 1Y, 1M and 1C are attached to or detached from the intermediate transfer belt 8.

After the Y, M, C and K toner images are transferred onto the intermediate transfer belt 8, the surfaces of the photoreceptors 1Y, 1M, 1C and 1K are subjected to a cleaning treatment to remove residual toner particles therefrom by the corresponding drum cleaners 4Y, 4M, 4C and 4K. After the photoreceptors 1 are discharged by discharging lamps, the photoreceptors are charged again by the corresponding chargers 2 to perform the next image formation.

After the combined color toner image is transferred from the intermediate transfer belt 8 to the recording medium P, the surface of the intermediate transfer belt 8 is cleaned by the belt cleaner 100 to remove residual toner particles (i.e., toner particles remaining on the intermediate transfer belt even after the transfer process) therefrom.

An optical sensor unit 150 is provided on the right side of the K process unit 6K so as to be opposed to the outer surface of the intermediate transfer belt 8 with a predetermined distance.

Figure 3:
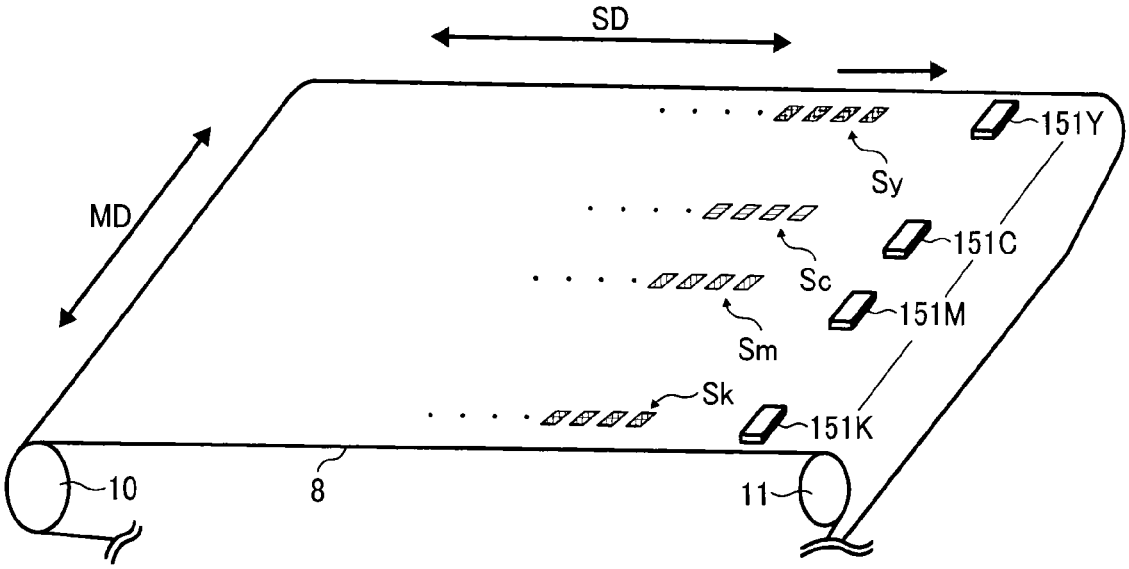
FIG. 3 is a schematic view illustrating an intermediate transfer medium of the printer on which half tone images are formed, and optical sensors provided in the vicinity thereof.

As illustrated in FIG. 3, the optical sensor unit 150 includes a Y optical sensor 151Y, a cyan optical sensor 151C, a M optical sensor 151M, and a K optical sensor 151K, which are arranged in the width direction of the intermediate transfer belt 8. In FIG. 3, MD denotes a main scanning direction, and SD represents a sub-scanning direction.

Each of these optical sensors 151 is a reflection type photosensor having a configuration such that light emitted from a light-emitting element (not shown) and reflected from the outer surface of the intermediate transfer belt 8 or a toner image on the belt is detected by a light receiving element (not shown) to determine the light quantity.

The printer 60 includes a controller 136 (illustrated in FIG. 9), which detects a toner image on the intermediate transfer belt 8 or the image density (i.e., weight of toner per a unit area) of the toner image based on the output voltage from the optical sensors 151Y, 151C, 151M and 151K.

Whenever the printer is turned on or a predetermined number of prints are formed, process control (image density control) is performed so that each of color images has a proper image density.

In the image density control, half tone pattern color toner images Sk, Sm, Sc and Sy (hereinafter referred to as a half tone image) are automatically formed on positions of the intermediate transfer belt 8 in which the color images face the corresponding optical sensors 151K, 151M, 151C, 151Y, respectively, as illustrated in FIG. 3. Each of the half tone images Sk, Sm, Sc and Sy has 10 toner images (hereinafter referred to as toner patches) which have different image densities and each of which has a size of 2 cm×2 cm.

When each of the half tone images Sk, Sm, Sc and Sy is formed, the potential of the photoreceptor 1 charged by the charger 2 is gradually increased unlike the normal charging process in which the photoreceptor is evenly charged to have a predetermined potential. Next, the photoreceptor 1 is scanned with laser light to form electrostatic latent images of the half tone images on the photoreceptor, and the electrostatic latent images are developed with the corresponding developing devices 5K, 5M, 5C and 5Y. In this development operation, each of the development biases applied to the developing rollers of the developing devices 5 is gradually increased. Thus, K, M, C and Y half tone images Sk, Sm, Sc and Sy are formed on the respective photoreceptors 1.

These half tone images Sk, Sm, Sc and Sy are primarily transferred onto the intermediate transfer belt 8 so as to be arranged in the width direction of the intermediate transfer belt (i.e., in the main scanning direction) at regular intervals as illustrated in FIG. 3. In this regard, the weight of the toner patch having the lowest image density is about 0.1 $mg/cm^2$, and the weight of the toner patch having the highest image density is about 0.55 $mg/cm^2$. In addition, the polarity of the color toners is the same, and each of the toners has a normal Q(charge quantity)/d(diameter) distribution.

The half tone images Sk, Sm, Sc and Sy formed on the intermediate transfer belt 8 pass under the respective optical sensors 151K, 151M, 151C and 151Y as the intermediate transfer belt makes endless movement. In this case, the optical sensors 151 receive light, which is reflected from the toner patches of the half tone images Sk, Sm, Sc and Sy and whose amount changes depending on the weight of the toner constituting the toner patches.

Next, the weights of the toners constituting the toner patches are calculated from the output voltages from the optical sensors 151 using a voltage-toner amount conversion algorithm, and the image forming conditions are adjusted based on the thus determined amounts of the toners.

Specifically, the relation between the toner weights of the toner patches and the development potentials in formation of the toner patches is graphed to obtain a function ($y=ax+b$) using a regression analysis method. By assigning a target image density to the function, a proper development bias can be calculated. Thus, the development biases for the developing devices 5Y, 5M, 5C and 5K can be determined.

A memory 137 (illustrated in FIG. 9) of the controller 136 stores an image forming condition data table concerning the relation between a development bias (in tens of levels) and the potentials of a photoreceptor. A development bias, which is nearest to the above-determined development bias, is selected from the data table for each of the process units 6Y, 6M, 6C and 6K, and the charge potential of the photoreceptor of the process unit corresponding to the development bias is determined. In this regard, the memory 137 is included in the controller 136 in FIG. 9, but may be provided independently of the controller 136.

Figure 4:
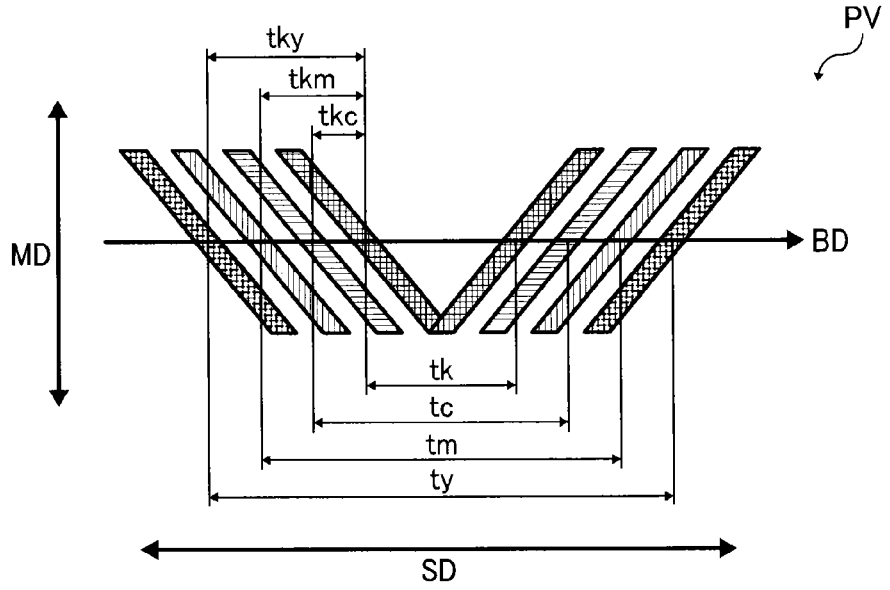
FIG. 4 is a schematic view illustrating a chevron patch formed on the intermediate transfer medium.
Figure 5:
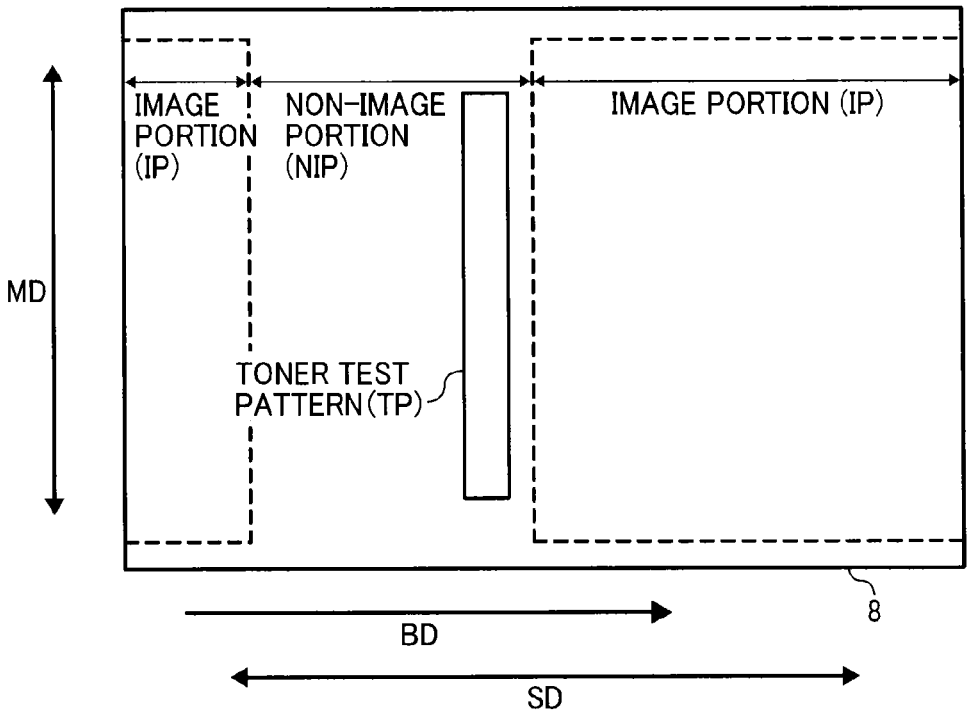
FIGS. 5-8 are schematic views illustrating toner test patterns transferred onto the intermediate transfer medium.

This printer performs a misalignment correction processing when the printer is turned on or after a predetermined number of prints are formed. In the misalignment correction processing, a chevron patch PV, which is constituted of Y, M, C and K color images as illustrated in FIG. 4, is formed on both end portions of the intermediate transfer belt 8 in the width direction thereof.

The chevron patch PV includes Y, M, C and K line images which are slanted by about 45° relative to the main scanning direction MD and which are arranged at regular intervals in a belt moving direction BD (i.e., the sub-scanning direction SD). The weight of the toner images of the chevron patch PV is about 0.3 $mg/cm^2$.

The Y, M, C and K color toner images of the chevron patches PV formed on both the end portions of the intermediate transfer belt 8 are detected to determine the positions of each toner image in the main scanning direction (MD) and the sub-scanning direction (SD), error in magnification ratio of each toner image in the main scanning direction, and skew of each toner image from the main scanning direction.

In this regard, the main scanning direction MD means the direction corresponding to the width direction of the photoreceptor, along which laser light reflected from a polygon mirror scans the surface of the photoreceptor 1.

The Y, M, C and K toner images of the chevron patch PV are detected by the respective optical sensors 151Y, 151M, 151C and 151K to determine the time differences (tky, tkm and tkc) between the K image (reference image) and each of the Y, M and C images. In the chevron patch PV illustrated in FIG. 4, Y, M, C and K images (left color images) are arranged from the left side, and other K, C, M and Y images (right images), which are slanted by 90° relative to the left color images, are arranged in this order in the belt moving direction BD (i.e., the sub-scanning direction SD). The data of the time differences (tky, tkm and tkc) are compared with the theoretical values thereof to determine the displacement of each toner image in the sub-scanning direction, i.e., the mis-registration. Based on the thus determined mis-registration, the optical image writing timing is adjusted by changing the reflection surface of the polygon mirror to reduce the mis-registration. In this regard, when the reflection surface is changed to the adjacent reflection surface, the change is a one-unit change.

In addition, the slant (skew) of each of the Y, M, C and K toner images is determined based on the mis-registrations on both the end portions of the intermediate transfer belt 8. Next, correction of the optical face tangle error of the polygon mirror is performed based on the results to reduce the skew of the toner images.

As mentioned above, the optical image writing timing is adjusted and the optical face tangle error is corrected based on the times at which the toner images of the chevron patches PV are detected to reduce the mis-registration and the skew of the images. This processing is a misalignment correction processing.

By performing this misalignment correction processing, occurrence of the misalignment problem in that positions of the color toner images change with time due to change of the environmental temperature can be prevented.

When images with a low image area proportion are continuously produced, the amount of the aged toner, which stays in the developing device 5 for a long period of time, increases, and therefore the charge property of the toner in the developing device deteriorates, thereby producing images having poor image quality (due to deterioration of developing ability and transferring property of the toner). Therefore, in order to prevent increase of the amount of such aged toners, the printer has a refresh mode in which toner images are formed on non-image areas of the photoreceptors 1 at predetermined times to use the toners in the developing devices 5 while supplying new toners to the developing devices to control the toner concentration in the developing devices.

The controller 136 (illustrated in FIG. 9) stores the consumption of the Y, M, C and K toners in the developing devices 5Y, 5M, 5C and 5K, and the operating times of the developing devices. At a predetermined time (i.e., after the developing devices are operated for a predetermined time), the controller 136 checks whether the toner consumption is less than a threshold value for each developing device. If the toner consumption in a developing device is less than the threshold value, the controller 136 performs the refresh mode on the developing device.

When the refresh mode is performed, a test pattern of each toner is formed on a non-image area (an area between two adjacent images) of the photoreceptor 1. The test patterns of the toners are transferred onto the intermediate transfer belt 8 as illustrated in FIGS. 5, 6, 7 and 8.

Figure 6:
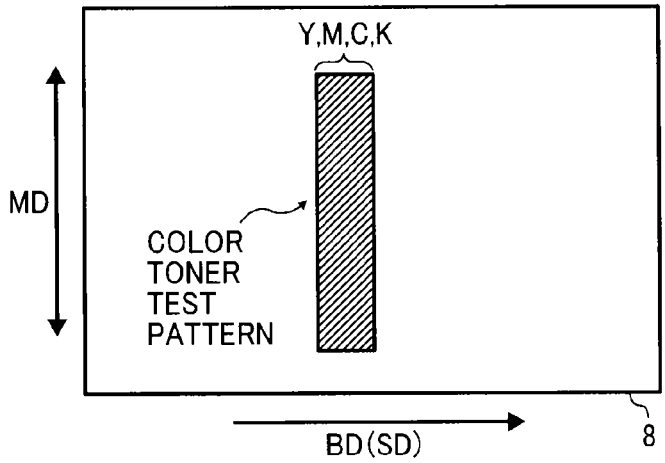

In FIG. 6, a test pattern of each toner is formed on the corresponding photoreceptor (in the order of Y, M, C and K toner images) under the following conditions, and the test patterns of the Y, M, C and K toners are transferred onto the intermediate transfer belt 8 so as to be overlaid.

Length of the test pattern in the sub-scanning direction (SD): 15 mm

Length of the test pattern in the main scanning direction (MD): 330 mm

Figure 7:
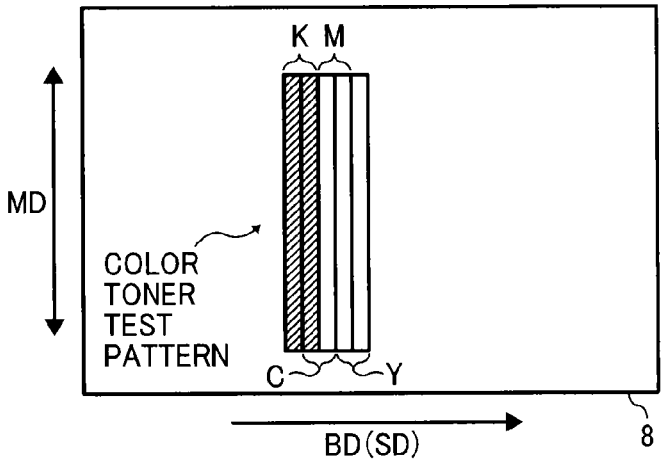

In FIG. 7, a test pattern of each toner is formed on the corresponding photoreceptor under the following conditions, and the test patterns of the Y, M, C and K toners are transferred onto the intermediate transfer belt 8 so as to be partially overlaid.

Length of the test pattern in the sub-scanning direction (SD): 10 mm

Length of the test pattern in the main scanning direction (MD): 330 mm

Figure 8:
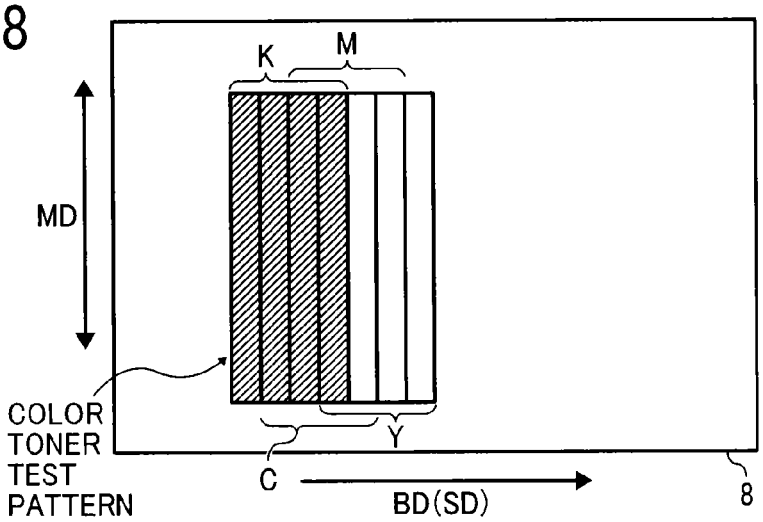

Length between the tip of the test pattern of the Y toner and the tip of the test pattern of the M toner in the belt moving direction (BD): 5 mm Length between the tip of the test pattern of the M toner and the tip of the test pattern of the C toner in the belt moving direction (BD): 5 mm Length between the tip of the test pattern of the C toner and the tip of the test pattern of the K toner in the belt moving direction (BD): 5 mm In FIG. 8, a test pattern of each toner is formed on the corresponding photoreceptor under the following conditions, and the test patterns of the Y, M, C and K toners are transferred onto the intermediate transfer belt 8 so as to be partially overlaid.

Length of the test pattern in the sub-scanning direction (SD): 20 mm

Length of the test pattern in the main scanning direction (MD): 330 mm

Length between the tip of the test pattern of the Y toner and the tip of the test pattern of the M toner in the belt moving direction (BD): 5 mm Length between the tip of the test pattern of the M toner and the tip of the test pattern of the C toner in the belt moving direction (BD): 5 mm Length between the tip of the test pattern of the C toner and the tip of the test pattern of the K toner in the belt moving direction (BD): 5 mm The lengths of the test patterns of the toners in the sub-scanning direction (SD) are determined based on the history of the general image forming operation. Therefore, the lengths of the toner test patterns in the belt moving direction are not limited to a certain length such as 15 mm, and the length is changeable in a range of from 0 to 15 mm for each test pattern. In this regard, the lengths of the Y, M, C and K toner test patterns are independent of each other.

The toner weight of the test pattern is determined based on the ratio (C/O) of the toner consumption (C) to the operating time (O) of the developing device 5, and the maximum toner weight is about 1.2 mg/cm$^2$. When the Q(charge quantity)/d (diameter) property of the toner of the toner test pattern transferred onto the intermediate transfer belt 8 is measured, it is confirmed that the toner has a normal Q/d distribution. The length of the test pattern in the main scanning direction MD is set to be 330 mm in this embodiment.

The half tone images, the chevron patches, and the toner test patterns formed on the intermediate transfer belt 8 are collected by the belt cleaner 100. In this case, the belt cleaner 100 has to remove a large amount of toners from the surface of the intermediate transfer belt 8.

In this regard, it is difficult to remove such a large amount of non-transferred toner at one time using conventional cleaners such as combination cleaners of a polarity controller and a brush roller, and combination cleaners of a first brush roller to remove a positive toner and a second brush roller to remove a negative toner.

In this case, residual toner remaining on the intermediate transfer belt 8 is transferred onto the recording medium P in the next image forming operation, resulting in formation of a defective image (background development).

The belt cleaner 100 of the image forming apparatus of this disclosure can remove such half tone images, chevron patches, and toner test patterns formed on the intermediate transfer belt at one time. Hereinafter, the belt cleaner 100 will be described in detail.

Figure 9:
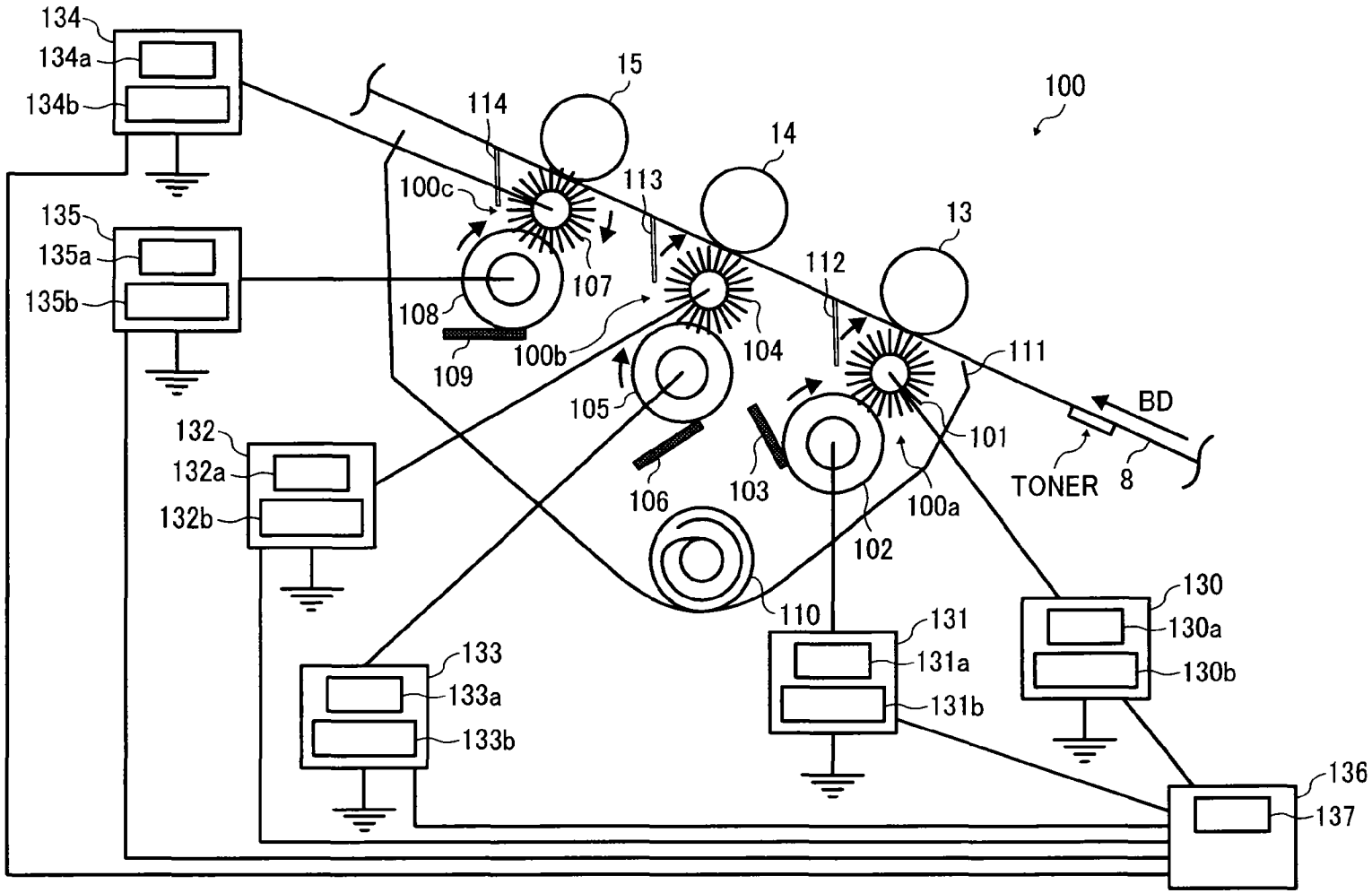
FIG. 9 is a schematic view illustrating a belt cleaner of the printer and vicinity thereof.

FIG. 9 is a schematic view illustrating the belt cleaner 100, which is a feature point of the present embodiment, and the vicinity thereof.

Referring to FIG. 9, the belt cleaner 100 includes a pre-cleaning portion 100*a*, which is provided on the extreme upstream side relative to the belt moving direction (BD) to roughly remove non-transferred toner images on the intermediate transfer belt 8. In addition, a reversely-charged toner cleaning portion 100*b* is provided on a downstream side from the pre-cleaning portion 100*a* relative to the belt moving direction (BD) to electrostatically remove reversely-charged toner particles (i.e., when the toner is a negative toner, the reversely charged toner is a positive toner) remaining on the intermediate transfer belt 8. Further, a normally-charged toner cleaning portion 100*c* is provided on a downstream side from the reversely-charged toner cleaning portion 100*b* relative to the belt moving direction (BD) to remove normally charged toner particles remaining on the intermediate transfer belt 8. Furthermore, a feeding screw 110 is provided to feed the collected toners to a waste toner tank (not shown) provided in the main body of the image forming apparatus.

The pre-cleaning portion 100*a* includes a pre-cleaning brush roller 101 serving as a pre-cleaning member, a toner collecting roller 102 which serves as a collecting member for pre-cleaning and which collects the toner adhered to the pre-cleaning brush roller 101, and a scraping blade 103 which serves as a scraper and which is contacted with the toner collecting roller 102 to scrape off the toner adhered to the surface of the toner collecting roller 102.

Almost all the toner particles constituting a non-transferred toner image are normally charged (in this case, the toners are negatively charged). Therefore, a positive voltage, which is opposite to the polarity of the normally charged toner, is applied to the pre-cleaning brush roller 101 to electrostatically removed negatively charged toner particles remaining on the intermediate transfer belt 8. In addition, a positive voltage greater than the positive voltage applied to the pre-cleaning brush roller 101 is applied to the toner collecting roller 102 to satisfactorily collect the toner adhered to the pre-cleaning brush roller 101. The voltage applied to the pre-cleaning brush roller 101 is adjusted so that 90% of the toner particles constituting the non-transferred toner image can be removed by the pre-cleaning brush roller.

The reversely-charged toner cleaning portion 100*b*, which is arranged on a downstream side from the pre-cleaning portion 101*a* relative to the belt moving direction BD, includes a reversely-charged toner cleaning brush roller 104 serving as a reversely-charged toner cleaning member to electrostatically remove reversely charged toner particles, a reversely-charged toner collecting roller 105, which serves as a reversely-charged toner collecting member and which collects the toner adhered to the reversely-charged toner cleaning brush roller 104, and a second scraping blade 106, which serves as a scraper and which is contacted with the reversely-charged toner collecting roller 105 to scrape off the reversely-charged toner adhered to the surface of the reversely-charged toner collecting roller 105.

A negative voltage is applied to the reversely-charged toner cleaning brush roller 104, and another negative voltage, whose absolute value is greater than that of the voltage applied to the brush roller 104, is applied to the reversely-charged toner collecting roller 105. In addition, this reversely-charged toner cleaner 100*b* has a function of a polarity controller, which imparts a negative charge to the residual toner particles on the intermediate transfer belt 8 to control the residual toner particles so as to have the normal polarity (i.e., the negative polarity, in this case).

The normally-charged toner cleaning portion 100*c*, which is arranged on a downstream side from the reversely-charged toner cleaner 100*b* relative to the belt moving direction BD, includes a normally-charged toner cleaning brush roller 107 serving as a normally-charged toner cleaning member to electrostatically remove normally charged toner particles, a normally-charged toner collecting roller 108, which serves as a normally-charged toner collecting member and which collects the toner adhered to the normally-charged toner cleaning brush roller 107, and a third scraping blade 109, which serves as a scraper and which is contacted with the normally-charged toner collecting roller 108 to scrape off the normally-charged toner adhered to the surface of the normally-charged toner collecting roller 108.

A positive voltage is applied to the normally-charged toner cleaning brush roller 107, and another positive voltage, which is greater than the positive voltage applied to the brush roller 107, is applied to the normally-charged toner collecting roller 108.

As illustrated in FIG. 9, the cleaning portions 100*a*, 100*b* and 100*c* respectively include cleaning power sources 130, 132 and 134, which respectively apply voltages to the cleaning brush rollers 101, 104 and 107. In addition, the cleaning portions 100*a*, 100*b* and 100*c* respectively include collection power sources 131, 133 and 135, which respectively apply voltages to the toner collecting rollers 102, 105 and 108.

The cleaning power sources 130, 132 and 134 respectively include power sources 130*a*, 132*a* and 134*a*, and detectors 130*b*, 132*b* and 134*b* to detect voltage and current. In addition, the collection power sources 131, 133 and 135 respectively include power sources 131*a*, 133*a* and 135*a*, and detectors 131*b*, 133*b* and 135*b* to detect voltage and current.

In addition, a controller 136 is provided to control the operations of the cleaning power sources 130, 131, 132, 133, 134 and 135. The controller 136 serves as the setup voltage changing device. The controller 136 includes a memory 137 to store information on the setup voltage value.

The pre-cleaning portion 100*a* and the reversely-charged toner cleaning portion 100*b* are separated from each other by a first insulating seal member 112, which is contacted with the pre-cleaning brush roller 101. Therefore, occurrence of problems such that discharging occurs between the pre-cleaning brush roller 101 and the reversely-charged toner cleaning brush roller 104; and the toner collected by the reversely-charged toner cleaning portion 100*b* is adhered again to the pre-cleaning brush roller 101 can be prevented.

The reversely-charged toner cleaning portion 100*b* and the normally-charged toner cleaning portion 100*c* are separated from each other by a second insulating seal member 113, which is contacted with the reversely-charged toner cleaning brush roller 104. Therefore, occurrence of problems such that discharging occurs between the reversely-charged toner cleaning brush roller 104 and the normally-charged toner cleaning brush roller 107; and the toner collected by the normally-charged toner cleaning portion 100*c* is adhered again to the reversely-charged toner cleaning brush roller 104 can be prevented.

In addition, at the exit of the belt cleaner 100, a third insulating seal member 114 is provided, which is contacted with the normally-charged toner cleaning brush roller 107. Therefore, occurrence of a problem such that discharging occurs between the normally-charged toner cleaning brush roller 107 and the tension roller 16 (illustrated in FIG. 2) can be prevented.

Further, the belt cleaner 100 includes an entrance seal 111, and a waste toner tank. The waste toner tank retains the toner collected by the pre-cleaning portion 100*a*, the reversely-charged toner cleaning portion 100*b* and the normally-charged toner cleaning portion 100*c*. In addition, the waste toner tank is detachably attached to the belt cleaner 100. Therefore, when a maintenance operation is performed, the waste toner tank is detached from the belt cleaner 100 to dispose of the waste toner contained in the waste toner tank.

In addition to the feeding screw 110, the printer can have a second feeding screw to feed the toner collected by the reversely-charged toner cleaning portion 100*b* and the normally-charged toner cleaning portion 100*c* to the waste toner tank provided in the main body of the printer.

Each of the cleaning brush rollers 101, 104 and 107 has a metal rotation shaft, which is rotatably supported, and a brush portion constituted of plural raised fibers provided on the outer periphery of the metal rotation shaft. The outer diameter of the brush rollers 101, 104 and 107 is from 15 mm to 16 mm.

The fibers have a double-layer structure such that electroconductive carbon is used for the inner portion of the fibers, and an insulating material such as polyester resins is used for the surface portion thereof. Therefore, the potential of the core portion of the fibers is substantially the same as the potential of the voltage applied to the cleaning brush rollers. Accordingly, the toner can be electrostatically attracted by the surface of the fibers of the brush rollers. Thus, the residual toner on the intermediate transfer belt 8 is electrostatically adhered to the fibers of the cleaning brush rollers 101, 104 and 107 due to the voltage applied to the brush rollers.

The structure of the fibers is not limited to the double-layer structure, and the fibers may be constituted only by an electroconductive material. In addition, the fibers may be provided on the rotation shaft so as to be slanted relative to the normal line of the rotation shaft.

Further, it is possible that the double-layer fibers are used for the pre-cleaning brush roller 101 and the normally-charged toner cleaning brush roller 107, and the fibers made only of an electroconductive material are used for the reversely-charged toner cleaning brush roller 104.

When fibers made of only an electroconductive material are used for the reversely-charged toner cleaning brush roller 104, charges can be easily injected from the cleaning brush roller 104 into the toner, thereby making it possible to control the polarity of the toner on the intermediate transfer belt 8 so as to be the normal polarity (i.e., negative polarity in this case).

When the double-layer fibers are used for the pre-cleaning brush roller 101 and the normally-charged toner cleaning brush roller 107, injection of charges into the toner can be prevented, thereby preventing occurrence of a problem in that the toner on the intermediate transfer belt 8 is reversely charged (i.e., the toner is positively charged). Using this method prevents occurrence of a problem in that toner particles, which cannot be electrostatically removed by the pre-cleaning brush roller 101 and the normally-charged toner cleaning brush roller 107, are formed on the intermediate transfer belt 8.

The cleaning brush rollers 101, 104 and 107 are contacted with the intermediate transfer belt 8 in such a manner that the length of the fibers of the brush rollers are 1 mm longer than the gap between the brush rollers and the intermediate transfer belt (i.e., the digging amount is 1 mm). Since the cleaning brush rollers 101, 104 and 107 are rotated by a driving device (not shown) in a direction opposite to the moving direction (BD) of the intermediate transfer belt 8 (i.e., the brush rollers counter the intermediate transfer belt), the velocity difference between the brush rollers and the intermediate transfer belt can be increased. Therefore, chance of contact of a portion of the intermediate transfer belt 8 with the brush rollers 101, 104 and 107 can be increased, thereby making it possible to satisfactorily remove the residual toner from the intermediate transfer belt.

A SUS (stainless steel) roller is used for the toner collecting rollers 102, 105 and 108 of the belt cleaner 100. However, the material of the rollers is not limited thereto, and any materials can be used therefor as long as the toner collecting rollers 102, 105 and 108 can have a function of transferring the toner adhered to the cleaning brush rollers to the collecting rollers utilizing the potential difference between the fibers of the brush rollers and the collecting rollers.

For example, each of the toner collecting rollers 102, 105 and 108 can have a structure such that an electroconductive shaft is covered with a high-resistance elastic tube having a thickness of from a few micrometers to 100 μm or coated with an insulating material, so that the resultant roller has a volume resistivity of from $10^{12}$ to $10^{14}$ Ω·cm.

Using a SUS roller for the toner collecting rollers 102, 105 and 108 has merits such that costs of the rollers can be reduced, and in addition the voltage to be applied to the rollers can be reduced, resulting in electric power saving.

In contrast, using a roller having a volume resistivity of from $10^{12}$ to $10^{14}$ Ω·cm for the toner collecting rollers 102, 105 and 108 has a merit such that when collecting the toner with the collecting rollers, injection of charges into the toner can be prevented, thereby preventing the toner from having the same polarity as that of the voltage applied to the collecting rollers, resulting in prevention of reduction of the toner collection rate.

The details of the cleaning brush rollers 101, 104 and 107 used for this belt cleaner 100 are as follows.

Material of brush: Electroconductive polyester (i.e., double-layer fiber in which the inner portion of the fiber includes electroconductive carbon, and the surface thereof is polyester resin)

Resistance of brush: $10^6$ to $10^8\Omega$

Density of fibers in brush: 60,000 to 150,000 pieces/inch$^2$ (i.e., 93 to 232.5 pieces/mm$^2$)

Diameter of fibers: about 25 μm to 35 μm

Lateral-buckling preventing treatment for brush: None

Diameter of brush roller: 14 mm to 20 mm

Setting position (digging amount) of brush rollers: The brush rollers are contacted with the intermediate transfer belt 8 in such a manner that the length of fibers is 1 to 1.5 mm longer than the gap between the brush rollers and the intermediate transfer belt.

The voltage applied to the pre-cleaning brush roller 101 is set to a voltage at which cleaning can be satisfactorily performed even when a large amount of non-transferred toner image is adhered to the intermediate transfer belt 8.

The voltage applied to the reversely-charged toner cleaning brush roller 104 is set to a relatively high voltage so that charges can be injected into the residual toner on the intermediate transfer belt 8. The conditions such as density of fibers in the brush, resistance of the brush, diameter of the fibers, applied voltage, material of the fibers, setting position (digging amount) of the brush rollers can be optimized depending on the system for which the brush rollers are used, and therefore the conditions are not limited to the above-mentioned conditions. Suitable materials for use as the fibers include nylon, acrylic resins, and polyester.

The conditions of the collecting rollers 102, 105 and 108 are as follows.

Material of core of rollers: SUS303

Setting position (digging amount) of collecting rollers: The collecting rollers are contacted with the brush rollers in such a manner that the length of fibers of the brush is 1 to 1.5 mm longer than the gap between the collecting rollers and the corresponding brush rollers.

Since the conditions such as material of the collecting rollers, setting of the collecting rollers and the applied voltage can be optimized depending on the system for which the collecting rollers are used, the conditions are not limited to the above-mentioned conditions.

The conditions of the scraping blades 103, 106 and 109 are as follows.

Material of blades: SUS304

Contact angle of blades: 20°

Thickness of blades: 0.1 mm

Setting position (digging amount) of blades: The blades are contacted with the corresponding collecting rollers in such a manner that the length of the blade is 0.5 to 1.5 mm longer than the gap between the blades and the corresponding collecting rollers.

Since the conditions such as contact angle, thickness of blades and setting of blades can be optimized depending on the system for which the blades are used, the conditions are not limited to the above-mentioned conditions.

Next, the cleaning operation of the belt cleaner 100 will be described.

As illustrated in FIG. 9, after passing the secondary transfer portion (i.e., the nip between the rollers 12 and 18 illustrated in FIG. 2), the residual toner particles (i.e., toner particles remaining on the intermediate transfer belt even after the transferring process) and non-transferred toner images (such as toner test patterns) present on the intermediate transfer belt 8 are fed by the rotated intermediate transfer belt so as to pass through the entrance seal 111, and then fed to the position, at which the residual toner particles and the non-transferred toner images face the pre-cleaning brush roller 101.

In this regard, a voltage with a polarity opposite to the polarity (negative polarity, in this case) of the normal toner particles is applied to the pre-cleaning roller 101, thereby forming an electric field between the intermediate transfer belt 8 and the pre-cleaning brush roller 101 due to potential difference therebetween. Therefore, negatively-charged toner particles on the intermediate transfer belt 8 are electrostatically adhered to the pre-cleaning brush roller 101.

The negatively-charged toner particles adhered to the pre-cleaning brush roller 101 are fed by the rotated pre-cleaning brush roller to the contact portion of the brush roller and the pre-cleaning collection roller 102, to which a positive voltage higher than the voltage applied to the pre-cleaning brush roller 101 is applied.

Therefore, the toner particles on the brush roller 101 are electrostatically transferred onto the pre-cleaning collecting roller 102 due to the electric filed formed by the difference in potential between the brush roller and the collecting roller.

The negatively-charged toner particles thus transferred onto the pre-cleaning collecting roller 102 are scraped off by the first scraping blade 103, and the toner particles thus scraped off are discharged from the belt cleaner 100 by the feeding screw 110.

Toner particles (such as negatively- or positively-charged toner particles in the non-transferred toner image, and positively-charged residual toners), which remain on the intermediate transfer belt 8 without being removed by the pre-cleaning brush roller 101, are fed to the reversely-charged toner cleaning brush roller 104.

Since a voltage having the same polarity (negative polarity in this case) as that of the normal toner particles is applied to the reversely-charged toner cleaning brush roller 104, charge injection or discharging is caused between the brush roller 104 and the toner particles, and thereby the toner particles are allowed to have a negative polarity.

In addition, toner particles, which maintain a positive charge even after charge injection or discharging, are electrostatically adhered to the reversely-charged toner cleaning brush roller 104 due to the electric field formed by the difference in potential between the brush roller 104 and the intermediate transfer belt 8.

The positively-charged toner particles adhered to the reversely-charged toner cleaning brush roller 104 are fed by the rotated brush roller to the contact portion of the brush roller and the reversely-charged toner collecting roller 105, to which a negative voltage greater (in absolute value) than the voltage applied to the brush roller 104 is applied.

The toner particles on the brush roller 104 are electrostatically transferred onto the collecting roller 105 due to the electric filed formed by the difference in potential between the brush roller and the collecting roller.

The positively-charged toner particles thus transferred onto the collecting roller 105 are scraped off by the second scraping blade 106, and the toner particles thus scraped off are discharged from the belt cleaner 100 by the feeding screw 110.

Toner particles (such as negatively-charged toner particles), which remain on the intermediate transfer belt 8 without being removed by the pre-cleaning brush roller 101 and the reversely-charged toner cleaning brush roller 104, are fed to the normally-charged toner cleaning brush roller 107.

In this regard, the toner particles fed to the brush roller 107 are allowed to have a negative charge by the reversely-charged toner cleaning brush roller 104. Since substantially all the toner particles on the intermediate transfer belt 8 have been removed therefrom by the brush rollers 101 and 104, the amount of the toner particles fed to the normally-charged toner cleaning brush roller 107 is very small.

The small amount of toner particles remaining on the intermediate transfer belt 8 are electrostatically adhered to the normally-charged toner cleaning brush roller 107, and then transferred onto the normally-charged toner collecting roller 108. The transferred toner particles are scraped off the normally-charged toner collecting roller 108 by the third scraping blade 109.

Thus, in the belt cleaner 100, a greater part of the negatively-charged toner particles constituting the non-transferred toner image are removed by the pre-cleaning brush roller 101, and therefore the amount of the toner particles fed to the reversely-charged toner cleaning brush roller 104 and the normally-charged toner cleaning brush roller 107 can be reduced.

The toner particles fed to the normally-charged toner cleaning brush roller 107 are toner particles, which have not been removed by the pre-cleaning brush roller 101 and the reversely-charged toner cleaning brush roller 104. Therefore, the amount of the toner particles fed to the normally-charged toner cleaning brush roller 107 is very small. In addition, the toner particles are negatively charged by the reversely-charged toner cleaning brush roller 104, and therefore the toner particles can be satisfactorily removed by the normally-charged toner cleaning brush roller 107. Therefore, even when a non-transferred toner image including a large amount of toner particles is formed on the intermediate transfer belt 8, the toner image can be satisfactorily removed from the intermediate transfer belt 8.

In addition, the residual toner particles, whose amount is less than the amount of toner particles constituting the non-transferred toner image, can be satisfactorily removed by the three brush rollers 101, 104 and 107.

In the belt cleaner 100, the reversely-charged toner cleaning brush roller 104 removes reversely (positively) charged toner particles on the intermediate transfer belt 8. However, the reversely-charged toner cleaning portion 100*b* can be replaced with a polarity controller, which controls the polarity of toner particles on the intermediate transfer belt 8 without removing the positively-charged toner particles. In this case, the toner particles on the intermediate transfer belt 8 are allowed to have a negative polarity by the polarity controller, and the negatively-charged toner particles are fed to the normally-charged toner cleaning brush roller 107 by the rotated intermediate transfer belt. The thus fed negatively-charged toner particles are removed by the normally-charged toner cleaning brush roller 107.

Suitable devices for use as the polarity controller include electroconductive brushes, electroconductive blades and corona chargers.

The polarity of the toner particles controlled by the polarity controller is not limited to the negative polarity, and can be the positive polarity. In this case, a cleaning brush roller, to which a negative voltage is applied, is arranged on the downstream side from the polarity controller relative to the moving direction (BD) of the intermediate transfer belt 8 to remove the positively charged toner particles from the intermediate transfer belt 8.

Even in such a belt cleaner, toner particles of the non-transferred toner image can be roughly removed by the pre-cleaning brush roller 101, and therefore the amount of the toner particles fed to the polarity controller is small. Therefore, the polarity controller can control the toner particles remaining on the intermediate transfer belt 8 to have a predetermined polarity, thereby making it possible to electrostatically remove the toner particles having the predetermined polarity with the cleaning brush roller provided on the downstream side from the polarity controller. Accordingly, even when a non-transferred toner image, which includes a large amount of toner particles, is fed to the belt cleaner 100, the toner particles can be satisfactorily removed from the intermediate transfer belt 8.

In addition, in this printer a voltage is applied to each of the collecting rollers 102, 105 and 108 and each of the cleaning brushes 101, 104 and 107. However, it is possible that a voltage is applied only to each of the collecting rollers 102, 105 and 108.

In this case, since the collecting rollers are contacted with the corresponding brush rollers and a voltage is applied to the collecting rollers, a voltage, which is slightly lower than the voltage applied to the collecting rollers due to potential drop caused by the resistance of the fibers of the brush rollers, is applied to the cleaning brush rollers. Therefore, a potential difference is formed between the collecting rollers and the cleaning brush rollers, and thereby the toner particles can be electrostatically transferred from the brush rollers 101, 104 and 107 to the corresponding collecting rollers 102, 105 and 108.

The belt cleaner 100 has to remove toner particles in an amount of from about 0.05 mg/cm$^2$ (such as residual toner particles) to about 1.0 mg/cm$^2$ (such as toner particles constituting a non-transferred toner image) from the intermediate transfer belt 8.

The targeted cleaning current, at which cleaning can be performed most optimally, changes depending on the amount of the toner particles on the intermediate transfer belt. Namely, as the amount of the toner particles increases, the targeted cleaning current increases. In this regard, the cleaning current means a current flowing through a contact portion of each of the cleaning brush rollers 101, 104 and 107 with the intermediate transfer belt 8. An example of the targeted cleaning current for residual toner particles and toner particles constituting a non-transferred toner image is shown in Table 1 below.

TABLE 1

| Print mode | Portion | Targeted current under LL* (μA) | Targeted current under MM* (μA) | Targeted current under HH* (μA) |
|---|---|---|---|---|
| Monochromatic mode | Pre-cleaning portion 100a (for non-transferred toner image) | 40 | 32 | 25 |
| | Pre-cleaning portion 100a (for residual toner particles) | 31 | 15 | 8 |
| | Reversely-charged toner cleaning portion 100b | −12 | −12 | −12 |
| | Normally-charged toner cleaning portion 100c | 15 | 10 | 5 |
| Full color mode | Pre-cleaning portion 100a (for non-transferred toner image) | 95 | 65 | 42 |
| | Pre-cleaning portion 100a (for residual toner particles) | 46 | 20 | 18 |
| | Reversely-charged toner cleaning portion 100b | −25 | −25 | −25 |
| | Normally-charged toner cleaning portion 100c | 25 | 22 | 20 |

LL*: Low temperature and low humidity conditions
MM*: Medium temperature and medium humidity conditions
HH*: High temperature and high humidity conditions The process linear speed of this printer can be changed in a range of from 100 to 800 mm/s, and is set to 350 mm/s in this embodiment.

The targeted current is set to a value, which is proportional to the process linear speed. For example, when the process linear speed is 175 mm/s, which is one half of the above-mentioned process linear speed (i.e., 350 mm/s), the targeted current is set to one half of the current at the process speed (350 mm/s). When the process linear speed is 700 mm/s, which is twice the above-mentioned process linear speed (i.e., 350 mm/s), the targeted current is set to twice the current at the process linear speed (350 mm/s).

Figure 10:
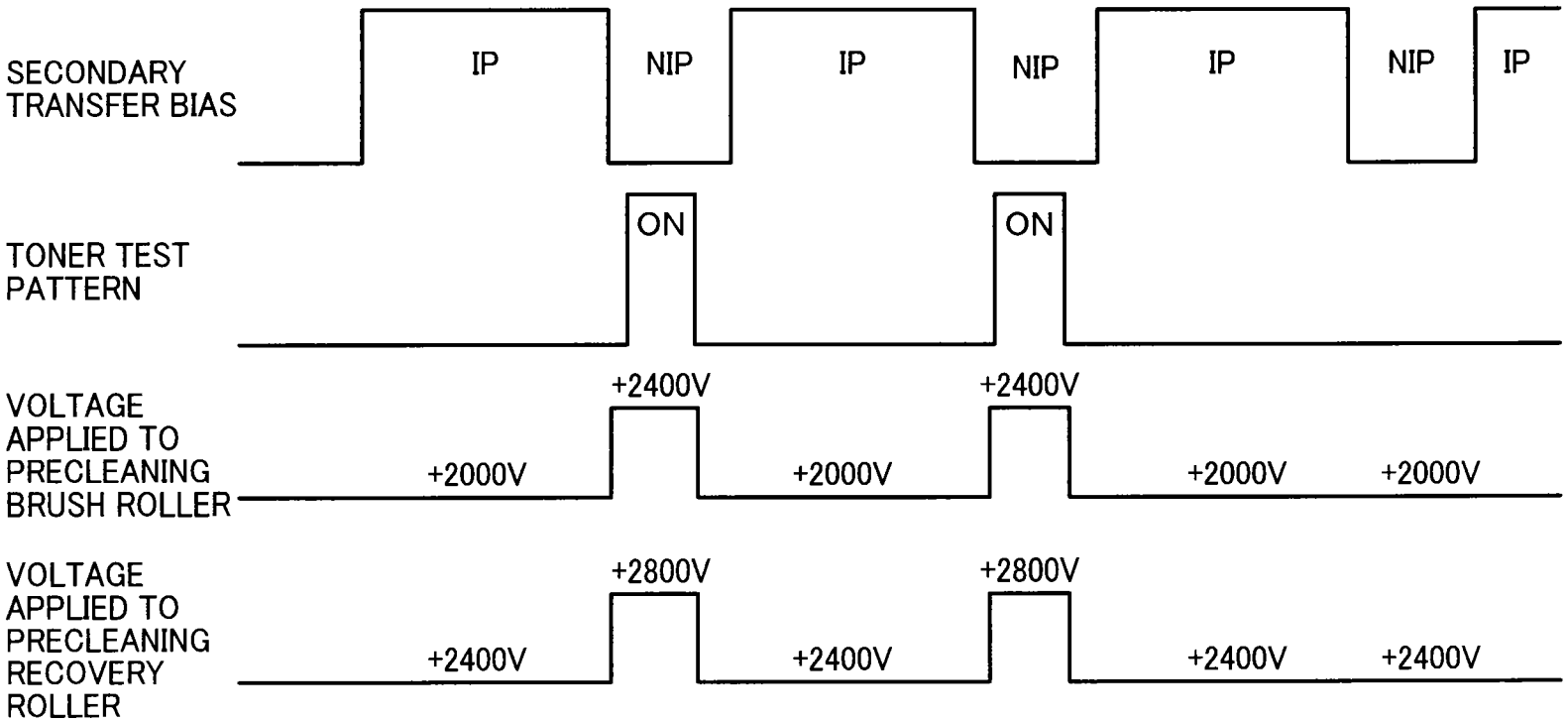
FIG. 10 is a timing chart illustrating timing of application of voltages to a pre-cleaning brush roller and a pre-cleaning toner collecting roller.

FIG. 10 is a timing chart illustrating timing of application of voltages to the pre-cleaning brush roller 101 and the pre-cleaning toner collecting roller 102. As illustrated in FIG. 10, switching of the voltage applied to the pre-cleaning brush roller 101 and the pre-cleaning toner collecting roller 102 is performed so that the targeted current flows and the residual toner particles and the non-transferred toner image are satisfactorily cleaned.

Specifically, when residual toner particles of an image formed in an image portion (IP) are cleaned, a relatively low voltage is applied to the pre-cleaning brush roller 101 and the pre-cleaning toner collecting roller 102 so that the residual toner particles can be satisfactorily removed from the intermediate transfer belt 8.

In contrast, when a refresh mode is performed and a toner test pattern is formed in a non-image portion (NIP), a relatively high voltage is applied to the pre-cleaning brush roller 101 and the pre-cleaning toner collecting roller 102 so that the non-transferred toner image can be satisfactorily removed from the intermediate transfer belt 8.

This voltage switching is performed just before the toner test pattern on the non-image portion reaches the pre-cleaning portion 100*a*.

In this embodiment, switching of the voltage applied to the pre-cleaning brush roller 101 and the pre-cleaning toner collecting roller 102 is performed. When no toner test pattern is formed in the non-image portion (NIP), the voltage switching is not performed.

Next, control of the voltage applied to the pre-cleaning brush roller 101 and the pre-cleaning toner collecting roller 102 will be described by reference to FIG. 10.

The controller 136 (illustrated in FIG. 9) memorizes the consumption of the Y, M, C and K toners in the developing device 5Y, 5M, 5C and 5K, and the operation times of the developing devices. In addition, at a predetermined time, the controller 136 checks whether the consumption of the toner in a predetermined period of time is not greater than a threshold value for each of the developing devices 5. If there is a developing device 5 in which the toner consumption is not greater than the threshold value, the controller performs the refresh mode on the developing device.

When the refresh mode is performed, a toner test pattern is formed in the non-image portion (NIP) corresponding to a portion of the photoreceptor 1 between two adjacent images. The toner test pattern is transferred from the photoreceptor 1 to the intermediate transfer belt 8. The amount (weight) of the toner test pattern is determined based on the information on the toner consumption in the predetermined operation time.

In this embodiment, the toner test pattern has a size of 25 mm in width and 250 mm in length, and is formed while starting from a position 15 mm apart from the front end of the non-image portion (NIP) of the photoreceptor 1.

As illustrated in FIG. 10, when the cleaner 100 faces a first image portion (IP), a voltage +2,000V is applied to the pre-cleaning brush roller 101 while a voltage +2,400V is applied to the pre-cleaning toner collecting roller 102 to remove residual toner particles on the image portion. When the cleaner faces a first non-image portion (NIP), a voltage +2,400V is applied to the pre-cleaning brush roller 101 while a voltage +2,800V is applied to the pre-cleaning toner collecting roller 102 to remove the non-transferred toner image on the non-image portion.

In this refresh mode, the voltage for the non-transferred toner image is applied in a predetermined period of time in which the non-transferred toner image is collected by the pre-cleaning toner collecting roller 102 from the pre-cleaning brush roller 101.

After the predetermined time for the refresh mode passes, the voltage applied to the pre-cleaning brush roller 101 is changed to +2,000V while the voltage applied to the pre-cleaning toner collecting roller 102 is changed to +2,400V to remove residual toner particles in the second image portion (IP).

Similarly, this voltage switching operation is performed at a time when the belt cleaner 100 faces the second non-image portion (NIP), and at a time when the belt cleaner faces the third image portion (IP).

As illustrated in FIG. 10, the refresh mode is not performed in the third non-image portion (NIP), and therefore a toner test pattern is not formed in the third non-image portion. Therefore, the voltage applied to the pre-cleaning brush roller 101 and the pre-cleaning toner collecting roller 102 is not changed (i.e., 2,000V and 2,400V, respectively).

By using this method, the toner can be transferred from the pre-cleaning brush roller 101 to the pre-cleaning toner collecting roller 102 even when a large amount of toner is adhered to the pre-cleaning brush roller 101, and therefore a problem in that the toner remains in the pre-cleaning brush roller 101 is not caused.

In this embodiment, when setting of the applied voltage is changed in the belt cleaner 100, the targeted current under the temperature and humidity conditions is read out from the table (illustrated in Table 1) based on the temperature and the humidity in the printer measured by a temperature/humidity sensor.

In this printer 60, the setup voltage changing process for the belt cleaner 100 is performed at a time other than the process control operation performed whenever the power of the printer is turned on or a predetermined number of prints are formed. Specifically, when changes of the temperature and the humidity in the printer 60 measured by the temperature/humidity sensor are not less than the predetermined values, the setup voltage changing process is performed.

For example, when the temperature change is 10° C. or more or the humidity change is 50% or more, the setup voltage changing process is performed so that the targeted current, which is described in the table and which is optimum for the current temperature and humidity, flows.

In the table illustrated in Table 1, the temperature and humidity conditions are classified into three conditions (i.e., LL, MM and HH). However, the temperature and humidity conditions may be classified into four or more conditions.

The setup voltage changing process of the belt cleaner 100 is performed after the belt cleaner is driven but the toner is not yet input to the belt cleaner. In this embodiment, the setup voltage changing process is performed on the cleaning brush rollers 101, 104 and 107, and the toner collecting rollers 102, 105 and 108 at the same time. Specifically, predetermined voltages are applied to the cleaning brush rollers 101, 104 and 107 and the toner collecting rollers 102, 105 and 108 by the respective power sources 130*a*, 131*a*, 132*a*, 133*a*, 134*a* and 135*a*.

The detectors 130*b* and 131*b* respectively detect the currents IB1 and IC1 flowing through the power sources 130*a* and 131*a*, which respectively apply the voltages to the pre-cleaning cleaning brush roller 101 and the pre-cleaning toner collecting roller 102.

The detectors 132*b* and 133*b* respectively detect the currents IB2 and IC2 flowing through the power sources 132*a* and 133*a*, which respectively apply the voltages to the reversely-charged toner cleaning brush roller 104 and the reversely-charged toner collecting roller 105.

In addition, the detectors 134*b* and 135*b* respectively detect the currents IB3 and IC3 flowing through the power sources 134*a* and 135*a*, which respectively apply the voltages to the normally-charged toner cleaning brush roller 107 and the normally-charged toner collecting roller 108.

In the setup voltage changing process, the applied voltages are set to the voltages by which the total IT1 of the currents IB1 and IC1, the total IT2 of the currents IB2 and IC2, and the total IT3 of the currents IB3 and IC3 become the targeted currents. In this regard, changes of setting of the voltages applied to the cleaning brush rollers 101, 104 and 107 and the toner collecting rollers 102, 105 and 108 are performed at the same time.

After the setup voltage changing process is performed, the image forming operations are performed under the same applied-voltage conditions until the next setup voltage changing process.

Figure 1A:
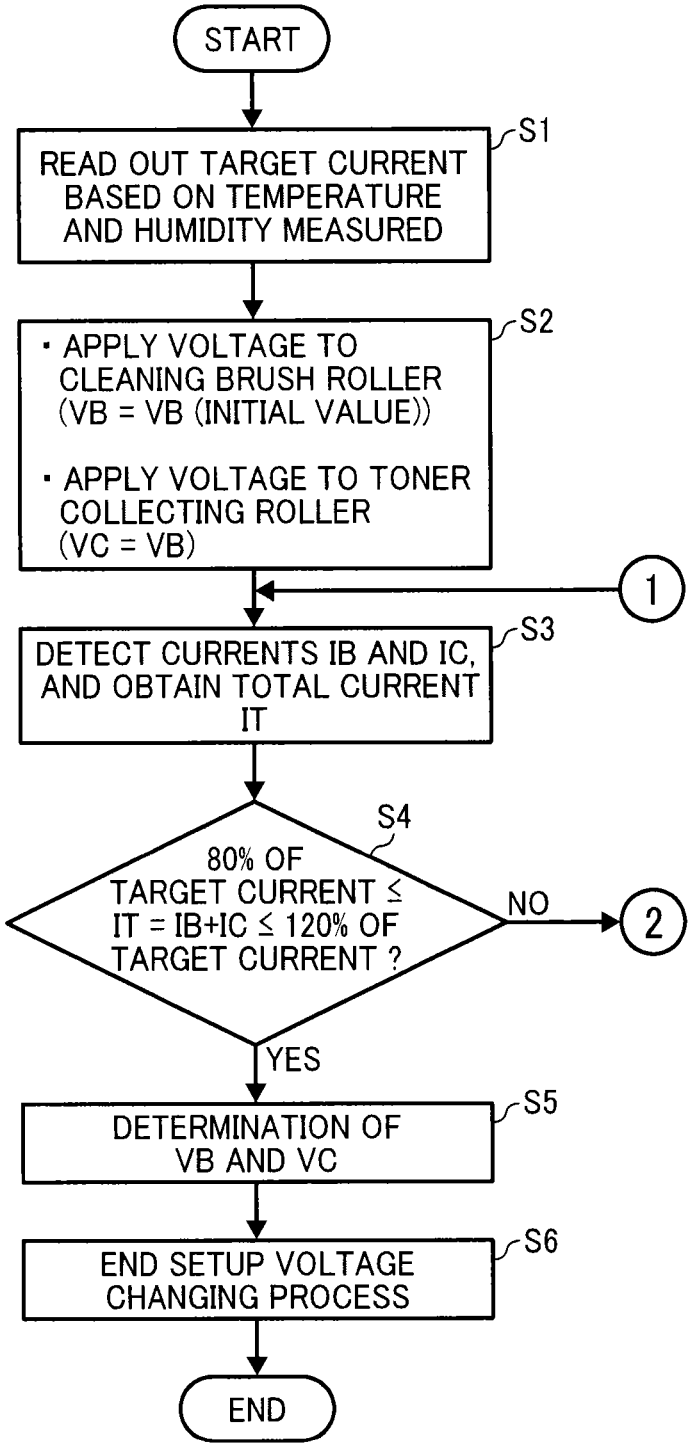
FIGS. 1A and 1B illustrate a flowchart of a setup voltage changing process for use in the cleaner according to an embodiment.
Figure 1B:
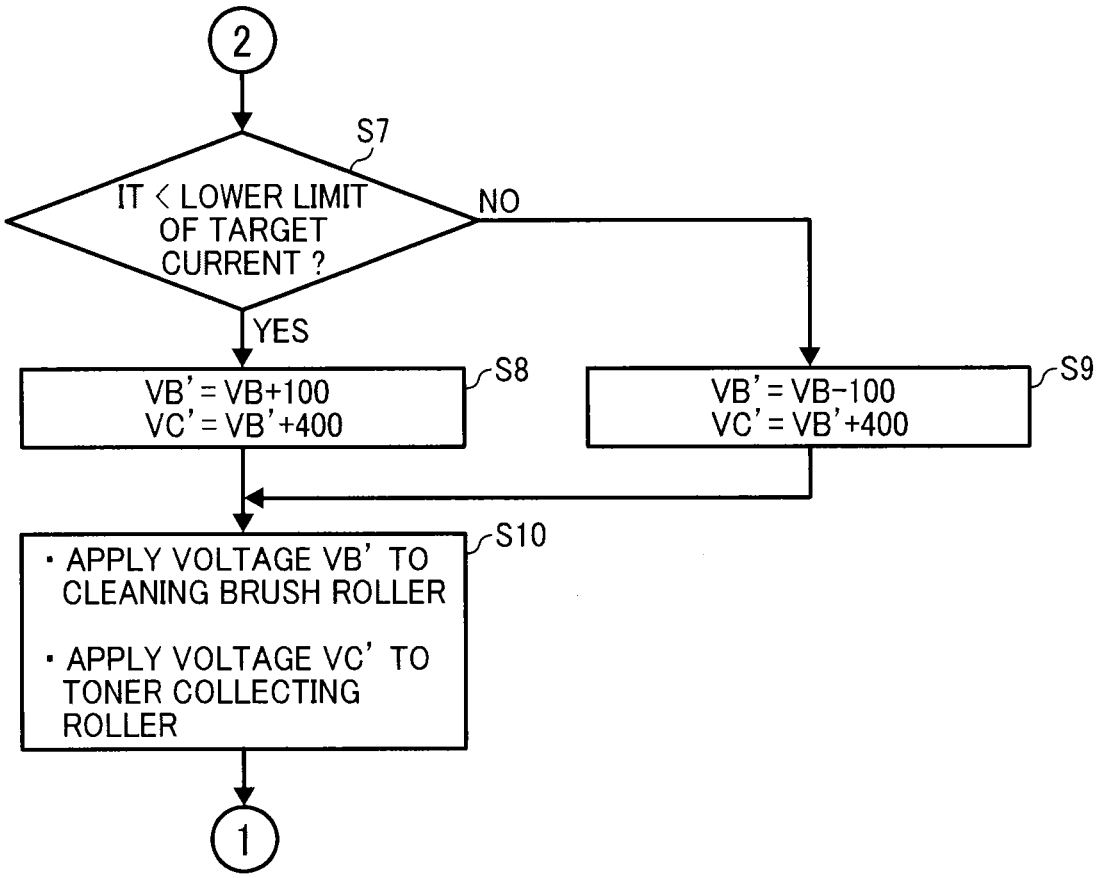

FIGS. 1A and 1B illustrate a flowchart illustrating an example of the setup voltage changing process. In FIGS. 1A and 1B, the cleaning portions 100*a*, 100*b* and 100*c* are not distinguished from each other because the setup voltage changing process is performed on the cleaning portions at the same time. In the setup voltage changing process, the initial voltages applied to the cleaning brush rollers 101, 104 and 107 and the toner collecting rollers 102, 105 and 108 are the same as the voltages set in the last setup voltage changing process, which are stored in the memory and which are read out. An example of the initial voltages is illustrated in Table 2 below.

TABLE 2

| Print mode | Roller | Initial voltage under LL* (V) | Initial voltage under MM* (V) | Initial voltage under HH* (V) |
|---|---|---|---|---|
| Monochromatic mode | Pre-cleaning brush roller 101 (for residual toner particles) | +4000 | +2000 | +200 |
| | Pre-cleaning brush roller 101 (for non-transferred toner image) | +4100 | +2300 | +800 |
| | Reversely-charged toner cleaning brush roller 104 (for residual toner particles) | −1800 | −1000 | −600 |
| | Reversely-charged toner cleaning brush roller 104 (for non-transferred toner image) | −1800 | −1000 | −600 |
| | Normally-charged toner cleaning brush roller 107 (for residual toner particles) | +2200 | +600 | +100 |
| | Normally-charged toner cleaning brush roller 107 (for non-transferred toner image) | +2200 | +600 | +100 |
| Full color mode | Pre-cleaning brush roller 101 (for residual toner particles) | +4000 | +2000 | +1400 |
| | Pre-cleaning brush roller 101 (for non-transferred toner image) | +6000 | +3000 | +1900 |
| | Reversely-charged toner cleaning brush roller 104 (for residual toner particles) | −2000 | −1800 | −1000 |
| | Reversely-charged toner cleaning brush roller 104 (for non-transferred toner image) | −2000 | −1800 | −1000 |
| | Normally-charged toner cleaning brush roller 107 (for residual toner particles) | +3000 | +1400 | +1100 |
| | Normally-charged toner cleaning brush roller 107 (for non-transferred toner image) | +3000 | +1400 | +1100 |

LL*: Low temperature and low humidity conditions
MM*: Medium temperature and medium humidity conditions
HH*: High temperature and high humidity conditions If a voltage far different from the voltage to be set is applied, the current flowing through a cleaning brush roller via the intermediate transfer belt 8 seriously increases, thereby accelerating deterioration of the cleaning brush rollers 101, 104 and 107, and the intermediate transfer belt 8.

Referring to FIGS. 1A and 1B, initially the targeted current under the temperature and humidity conditions corresponding to the measured temperature and humidity in the printer is read out from the setting table illustrated in Table 1 (step S1).

The six power sources 130*a*, 131*a*, 132*a*, 133*a*, 134*a* and 135*a* apply the predetermined voltages to the corresponding cleaning brush rollers 101, 104 and 107 and the toner collecting rollers 102, 105 and 108 (step S2).

In this regard, the initial voltages described in Table 2 (i.e., the voltages set in the last setup voltage changing process) are read out to be used as the voltages VB1, VB2 and VB3 applied to the cleaning brush rollers 101, 104 and 107. In addition, voltages 400V higher than the voltages VB1, VB2 and VB3 are applied to the toner collecting rollers 102, 105 and 108 as the voltages VC1, VC2 and VC3.

Next, the currents IB1, IB2 and IB3 flowing through the power sources 130*a*, 132*a* and 134*a*, which respectively apply voltages to the cleaning brush rollers 101, 104 and 107, are detected by the detectors 130*b*, 132*b* and 134*b*. Similarly, the currents IC1, IC2 and IC3 flowing through the power sources 131*a*, 133*a* and 135*a*, which respectively apply voltages to the toner collecting rollers 102, 105 and 108, are detected by the detectors 131*b*, 133*b* and 135*b*. In addition, the total IT1 of the currents IB1 and IC1, the total IT2 of the currents IB2 and IC2, and the total IT3 of the currents IB3 and IC3 are obtained (step S3).

Next, whether or not the total currents IT1, IT2 and IT3 are not less than 80% of the targeted currents and not greater than 120% of the targeted currents is determined (step S4).

If the total currents IT1, IT2 and IT3 are not less than 80% of the targeted currents and not greater than 120% of the targeted currents (Yes in step S4), the voltages VB1, VB2 and VB3 and the voltages VC1, VC2 and VC3 are used as the setup voltages (step S5), and the setup voltage changing process is ended (step S6).

If the total currents IT1, IT2 and IT3 do not fall in the range of from 80% to 120% of the targeted currents (No in step S4), whether or not the total currents IT1, IT2 and IT3 are less than the lower limit of the targeted currents is determined (step S7).

If the total currents IT1, IT2 and IT3 are less than the lower limit of the targeted currents (Yes in step S7), voltages (VB'1, VB'2 and VB'3), which are 100V higher than the VB1, VB2 and VB3, are determined, and voltages (VC'1, VC'2 and VC'3), which are 400V higher than the voltages VB' 1, VB'2 and VB'3, are determined (step S8).

If the total currents IT1, IT2 and IT3 are greater than the lower limit of the targeted currents (No in step S7), voltages (VB' 1, VB'2 and VB'3), which are 100V lower than the VB1, VB2 and VB3, are determined, and voltages (VC'1, VC'2 and VC'3), which are 400V higher than the voltages VB'1, VB'2 and VB'3, are determined (step S9).

Next, the voltages VB'1, VB'2 and VB'3 are applied to the cleaning brush rollers 101, 104 and 107, and the voltages VC'1, VC'2 and VC'3 are applied to the toner collecting rollers 102, 105 and 108, respectively (step S10). Next, detection of the currents IB1, IB2 and IB3, and the currents IC1, IC2 and IC3 is performed (step S3), and then the series of steps mentioned above are performed.

In this embodiment, change of setting of the voltage for removing a non-transferred toner image is performed prior to change of setting of the voltage for removing residual toner particles.

As a result of investigation of the present inventors, it is found that if change of setting of the voltage for the pre-cleaning portion 100*a* (i.e., the voltage for removing residual toner particles) is initially performed, the voltage tends to be set to a relatively high voltage.

Toner particles collected by the pre-cleaning brush roller 101 are collected by the pre-cleaning toner collecting roller 102, but part of the toner particles remains in the brush roller. Therefore, toner particles accumulate in the brush roller 101 with time. In this case, the apparent electric resistance of the pre-cleaning brush roller 101 increases In this case, when a high voltage (i.e., a voltage for removing a non-transferred toner image) is applied to the pre-cleaning brush roller 101, the polarity of the toner particles in the brush roller is reversed, and therefore the toner particles are discharged from the brush, resulting in re-adhesion of the toner particles to the intermediate transfer belt 8. Since the toner particles in the brush are transferred to the intermediate transfer belt 8, the apparent resistance of the brush of the pre-cleaning brush roller 101 becomes lower than in the case in which the toner particles are present in the brush.

In contrast, when a relatively low voltage (i.e., a voltage for removing residual toner particles) is applied to the pre-cleaning brush roller 101, the polarity of the toner particles in the brush is not easily reversed. Therefore, the phenomenon in that the toner particles in the brush release from the brush and are adhered again to the intermediate transfer belt 8 hardly occurs.

In consideration of these results, a case in which the setup voltage changing process for the voltage for removing residual toner particles is initially performed, and then the setup voltage changing process for the voltage for removing a non-transferred toner image is performed will be considered. Specifically, in the first setup voltage changing process, the setup voltage changing process is performed so that the targeted current can be obtained under a condition such that the pre-cleaning brush roller 101 has a relatively high apparent resistance due to accumulation of toner particles therein.

In the second setup voltage changing process for the voltage for removing a non-transferred toner image, the toner particles in the brush are adhered again to the intermediate transfer belt 8. Therefore, the setup voltage changing operation is performed under a condition such that the pre-cleaning brush roller 101 has a relatively low apparent resistance compared to the first setup voltage changing process.

Thereafter, the setup voltage changing processes for the reversely-charged toner cleaning portion 100*b* and the normally-charged toner cleaning portion 100*c* are performed under the condition such that the pre-cleaning brush roller 101 has a relatively low apparent resistance.

When an image forming operation is performed after performing the series of setup voltage changing processes mentioned above, the apparent resistance of the brush of the pre-cleaning brush roller 101 is relatively low compared to that in the setup voltage changing process for the voltage for removing residual toner particles. Therefore, if the setup voltage is applied, a current greater than the targeted current flows through the pre-cleaning portion 100*a*. Namely, the setup voltage is higher than a proper voltage.

When a current greater than the targeted current flows in the pre-cleaning portion 100*a*, toner particles on the intermediate transfer belt 8 cannot be easily removed by the pre-cleaning brush roller 101, and the amount of the toner particles remaining on the intermediate transfer belt 8, which are fed to the reversely-charged toner cleaning portion 100*b* and the normally-charge toner cleaning portion 100*c*, increases. In this case, the burden on the reversely-charged toner cleaning portion 100*b* and the normally-charged toner cleaning portion 100*c* increases, thereby causing a problem in that the lives of the reversely-charged toner cleaning brush roller 104 and the normally-charged toner cleaning brush roller 107 shorten, and therefore the life of the belt cleaner 100 shortens.

In addition, when the amount of toner particles fed to the reversely-charged toner cleaning portion 100*b* and the normally-charge toner cleaning portion 100*c* increases to an extent such that the amount is greater than the amount of toner particles which the brush rollers 104 and 107 can remove, a defective cleaning problem in that the toner particles on the intermediate transfer belt 8 cannot be satisfactorily removed is caused.

In contrast, when the setup voltage changing process for the voltage for removing a non-transferred toner image is initially performed, and then the setup voltage changing process for the voltage for removing residual toner particles is performed, the problem in that the voltage is set to a high voltage is not caused.

For the reason mentioned above, in this embodiment the setup voltage changing process for the voltage for removing a non-transferred toner image is performed under a condition such that the apparent resistance of the brush of the pre-cleaning brush roller 101 is relatively low. In addition, the next setup voltage changing process for the voltage for removing residual toner particles is performed under the same condition. Further, the following setup voltage changing processes for the reversely-charged toner cleaning portion 100*b* and the normally-charge toner cleaning portion 100*c* are also performed under the same condition.

When a normal image forming operation is performed after performing the series of setup voltage changing processes mentioned above, the apparent resistance of the brush of the pre-cleaning brush roller 101 is still relatively low. Therefore, the apparent resistance of the brush of the pre-cleaning brush roller 101 in the normal image forming operation is the same as that in the voltage setting process. Therefore, since the setup voltage for removing residual toner particles is applied, the targeted current can be flowed, and thereby satisfactory cleaning can be performed by the pre-cleaning portion 100*a*. Namely, the voltage for removing residual toner particles is set to a proper voltage As mentioned above, in the setup voltage changing process for the pre-cleaning portion 100*a*, by performing the setup voltage changing process for the voltage for removing a non-transferred toner image prior to the setup voltage changing process for the voltage for removing residual toner particles, both the voltages can be set to respective optimum voltages.

Figure 12:
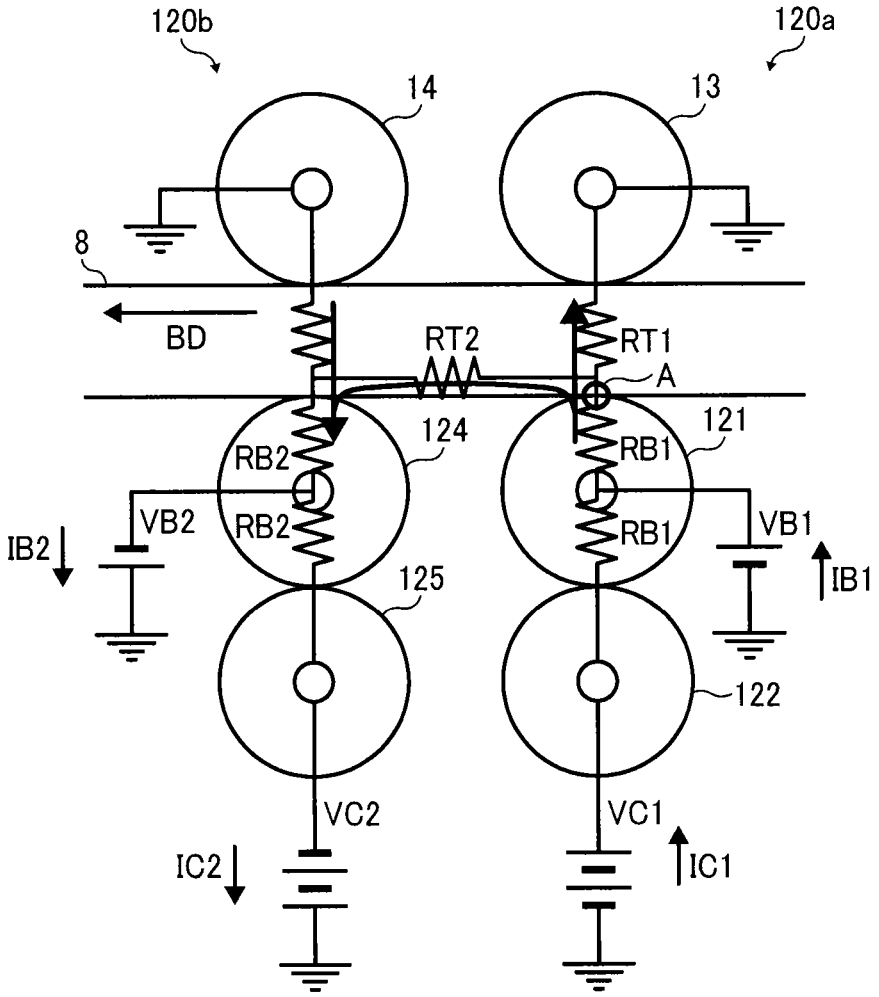
FIG. 12 is a schematic view illustrating an electric circuit of the belt cleaner illustrated in FIG. 11.

As illustrated in FIG. 9, the cleaning brush rollers 101, 104 and 107 are respectively paired with counter rollers 13, 14 and 15 with the intermediate transfer belt 8 therebetween. Therefore, the rollers form such an equivalent circuit as illustrated in FIG. 12, and therefore currents flow intricately. Therefore, it is considered that the setup voltage cannot be set to a voltage, by which the targeted current can be flowed, due to the complex current flow if the setup voltage changing process is performed one by one on the cleaning brush rollers 101, 104 and 107.

In contrast, when one counter member is used for all the cleaning brush rollers 101, 104 and 107 instead of the three counter rollers 13, 14 and 15, a current flows along the backside of the intermediate transfer belt 8, and therefore a problem in that the cleanability of the belt cleaner 100 cannot be enhanced even when the setup voltage changing process is performed tends to be caused. FIG. 12 will be described later in detail.

In contrast, in this embodiment, the setup voltage changing processes for the cleaning brush rollers 101, 104 and 107 are performed at the same time. By using this method, the voltages can be set to optimum voltages, by which targeted currents can be flowed, in consideration of the intricate current flow.

The targeted current in the full color image print mode is different from that in the monochrome image print mode. This is because the secondary transfer condition (such as secondary transfer voltage applied for transferring a toner image from the intermediate transfer belt 8 to a recording medium) in the full color image print mode is different from that in the monochrome image print mode, and therefore the charge quantity and the amount of the toner fed to the cleaner 100 are different. Therefore, the targeted current in the full color image print mode is different from that in the monochrome image print mode.

When the setup voltage changing process is performed, it is preferable that a secondary transfer voltage is applied to the secondary transfer portion. By using this method, the setup voltage changing process can be performed under the same condition as that in the image forming operation, i.e., the setup voltage changing process can be performed in consideration of the electrical impact that the intermediate transfer belt 8 receives at the secondary transfer portion, and therefore the voltage can be set to the optimum voltage.

In addition, when the setup voltage changing process is performed, it is preferable that the primary transfer rollers 9 are separated from the photoreceptors 1 with the intermediate transfer belt 8 therebetween (i.e., the photoreceptors 1 are separated from the intermediate transfer belt at the primary transfer portion). By using this method, the surface of the intermediate transfer belt 8 does not bear residual toner particles, which are transferred from the developing devices 5 via the photoreceptors 1, and therefore the setup voltage changing process can be performed without affected by such residual toner particles.

Figure 11:
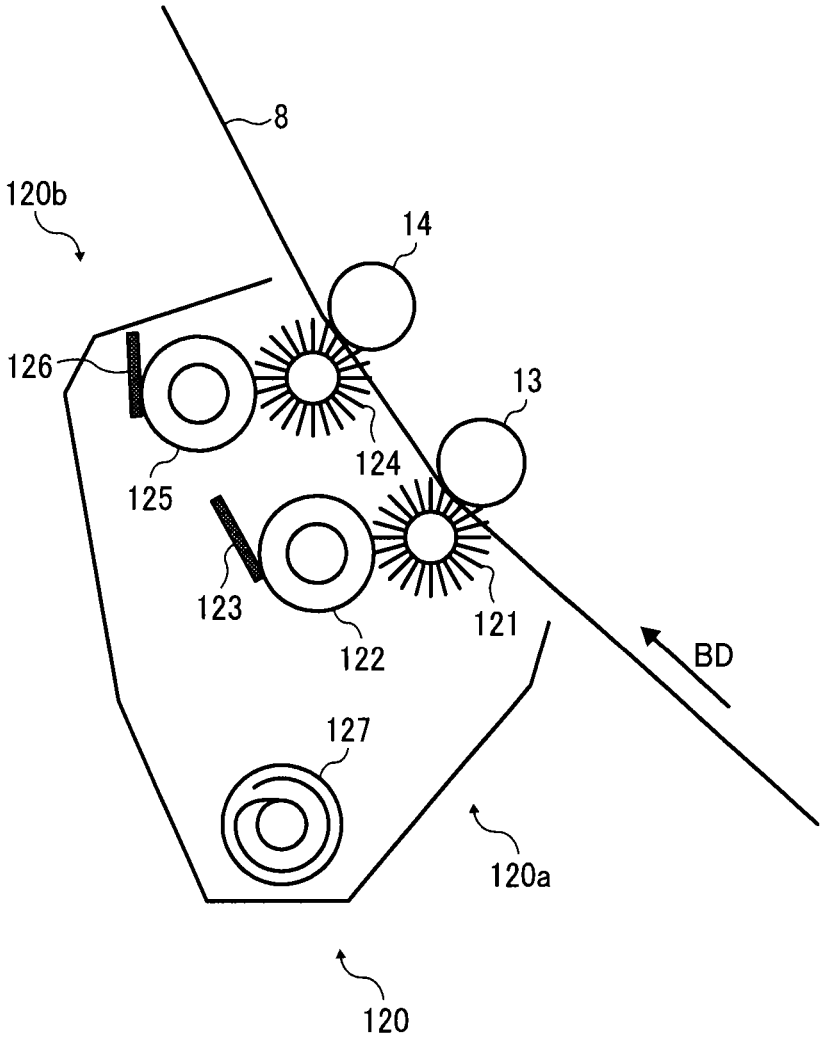
FIG. 11 is a schematic view illustrating another belt cleaner to perform cleaning using two brush rollers.

FIG. 11 illustrated a belt cleaner 120, which can be used for the printer of this embodiment and which includes two cleaning brush rollers, and the vicinity thereof.

The belt cleaner 120 includes a first cleaning portion 120*a* to remove toner particles having a normal polarity (i.e., negative polarity in this case) on the intermediate transfer belt 8, and a second cleaning portion 120*b*, which is arranged on a downstream side from the first cleaning portion relative to the belt moving direction (BD) to remove toner particles having a reverse polarity (i.e., positive polarity in this case) on the intermediate transfer belt 8.

The first cleaning portion 120*a* includes a first cleaning brush roller 121, a first toner collecting roller 122, and a first scraping blade 123. The first cleaning brush roller 121 includes a rotatably supported metal shaft, and a brush roller portion, which is provided on the surface of the metal shaft so as to be erected and which is constituted of plural fibers (electroconductive fibers).

The second cleaning portion 120*b* is arranged on a downstream side form the first cleaning portion 120*a* relative to the moving direction of the intermediate transfer belt 8, and includes a second cleaning brush roller 124, a second toner collecting roller 125, and a second scraping blade 126. The second cleaning brush roller 124 includes a rotatably supported metal shaft, and a brush roller portion, which is provided on the surface of the metal shaft so as to be erected and which is constituted of plural fibers (electroconductive fibers).

In addition, the belt cleaner 120 includes a feeding screw 127 to feed the toner collected by the first cleaning portion 120*a* and the second cleaning portion 120*b* to an end of the casing of the belt cleaner 120 to discharge the toner from the casing. The toner discharged from the belt cleaner 120 by the feeding screw 127 falls into a waste toner tank or is returned to the developing device 5.

One example of the operation condition of the belt cleaner 120 (i.e., the targeted current IB+IC) is illustrated in Table 3 below.

TABLE 3

| | | IB + IC (μA) | |
|---|---|---|---|
| Environmental condition | Cleaning portions | Normal linear speed | Half speed mode |
| Low temperature and low humidity condition (LL) | First cleaning portion (for removing non-transferred toner image) | 76 | 38 |
| | First cleaning portion (for removing residual toner particles) | 37 | 19 |
| | Second cleaning portion | −23 | −12 |
| Medium temperature and medium humidity condition (MM) | First cleaning portion (for removing non-transferred toner image) | 65 | 33 |
| | First cleaning portion (for removing residual toner particles) | 20 | 10 |
| | Second cleaning portion | −25 | −13 |

TABLE 3-continued

| Environmental condition | Cleaning portions | IB + IC (μA) Normal linear speed | Half speed mode |
|---|---|---|---|
| High temperature and high humidity condition (HH) | First cleaning portion (for removing non-transferred toner image) | 42 | 21 |
| | First cleaning portion (for removing residual toner particles) | 18 | 9 |
| | Second cleaning portion | −30 | −15 |

The amount of toner fed to the first cleaning portion 120*a* changes in a wide range of from 0.05 to 1.0 mg/cm$^2$. Therefore, two kinds of targeted currents, i.e., a targeted current for removing a non-transferred toner image including a relatively large amount of toner, and another targeted current for removing residual toner particles, the amount of which is relatively small, are set.

Since the second cleaning portion 120*b* cleans the surface of the intermediate transfer belt 8 after the surface is cleaned by the first cleaning portion 12*a*, the amount of toner on the intermediate transfer belt 8 to be removed by the second cleaning portion is small, and therefore one targeted current is set therefor.

In this example, two levels of targeted currents are set for the first cleaning portions (i.e., the target current for removing a non-transferred toner image, and the target current for removing residual toner particles), but the level is not limited thereto. For example, the targeted current can be classified into three or more levels depending on the amount of toner on the intermediate transfer belt 8.

FIG. 12 is a schematic view illustrating an equivalent circuit corresponding to the belt cleaner 120.

The current flowing through cleaning portions, in which toner is transferred from the intermediate transfer belt 8 to the cleaning brush rollers 121 and 124, contributes to cleaning. For example, in the first cleaning portion 120*a*, the current flowing through a point A illustrated in FIG. 12 contributes to cleaning. The current is a total of a current (IB1) flowing through a power source applying a bias to the first brush roller 121 and a current (IC1) flowing through a power source applying a bias to the first toner collecting roller 122. In the second cleaning portion 120*b*, the current is a total of a current (IB2) and a current (IC2).

In FIG. 12, RT1, RT2, RB1 and RB2 represent resistances of the intermediate transfer belt 8, the first brush roller 121, and the second brush roller 124, and VB1, VC1, VB2 and VC2 represent applied voltages.

Next, the toner for use in the printer will be described.

In order to form fine dot images with a resolution of not less than 600 dpi, the toner preferably has a volume average particle diameter of from 3 μm to 6 μm. In addition, the Dv/Dn ratio of the volume average particle diameter (Dv) to the number average particle diameter (Dn) of the toner is preferably from 1.00 to 1.40. In this regard, as the Dv/Dn ratio approaches 1.00, the toner has a sharper particle diameter distribution. Such a toner as having a small particle diameter and a sharp particle diameter distribution has a sharp charge quantity distribution, and therefore high quality toner images without background development can be produced. In addition, when an electrostatic transferring method is used for image formation, the transferring rate can be enhanced.

Figure 13:
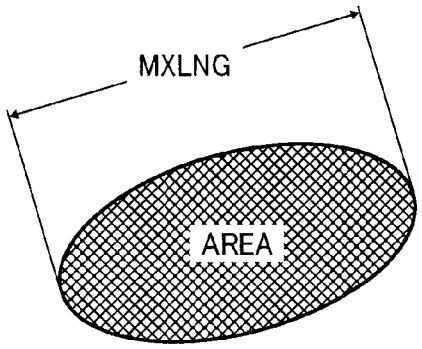
FIG. 13 is a schematic view for use in describing a shape factor SF-1 of toner.

The toner preferably has a first shape factor SF-1 of from 100 to 180, and a second shape factor SF-2 of from 100 to 180. FIG. 13 is a schematic view for describing the first shape factor SF-1. The first shape factor SF-1 represents the degree of the roundness of a toner particle, and is defined by the following equation:

$$SF\text{-}1=\{(MXLNG)^2/(AREA)\}\times(100\pi/4),$$

wherein MXLNG represents the maximum diameter of the projected image of a toner particle formed on a two-dimensional plane, and AREA represents the area of the projected image.

When the first shape factor SF-1 is 100, the toner particle is spherical. As the shape factor SF-1 increases, the shape of the toner particle becomes more irregular.

Figure 14:
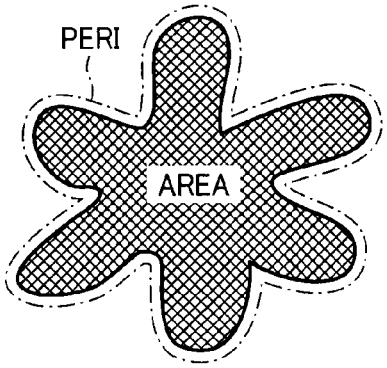
FIG. 14 is a schematic view for use in describing another shape factor SF-2 of toner.

FIG. 14 is a schematic view for describing the second shape factor SF-2. The second shape factor SF-2 represents the degree of the concavity and convexity of a toner particle, and is defined by the following equation:

$$SF\text{-}2=\{(PERI)^2/(AREA)\}\times(100/4\pi),$$

wherein PERI represents the peripheral length of the projected image of a toner particle formed on a two-dimensional plane, and AREA represents the area of the projected image.

When the second shape factor SF-2 is 100, the toner particle has a smooth surface (i.e., the toner has no concavity and convexity). As the SF-2 increases, the toner particle has a rougher surface.

The first and second shape factors SF-1 and SF-2 are determined by the following method:

(1) particles of a toner are photographed using a scanning electron microscope (S-800, manufactured by Hitachi Ltd.); and (2) photograph images of one hundred toner particles are analyzed using an image analyzer (LUZEX 3 manufactured by Nireco Corp.) to determine the first and second shape factors SF-1 and SF-2 of the toner.

When the shape of a toner approaches the spherical form, toner particles of the toner make a point contact with each other. Therefore, the adsorption force between toner particles weakens, and thereby the fluidity of the toner is enhanced. In addition, adsorption force between toner particles and a photoreceptor 1 weakens, and thereby the transfer rate of the toner is increased. When one of the shape factors SF-1 and SF-2 exceeds 180, the transfer rate of the toner deteriorates, and therefore it is not preferable.

Toners used for color printers are preferably prepared by a method including preparing a toner component liquid in which at least a polyester prepolymer having a nitrogen-containing functional group, a polyester, a colorant and a release agent are dissolved or dispersed in an organic solvent; and subjecting the toner component liquid to at least one of a crosslinking reaction and a polymer chain growth reaction in an aqueous medium to form toner particles. Hereinafter the toner constituents of the toner, and the preparation method thereof will be described.

(Polyester)

Polyester can be prepared by subjecting a polyalcohol and a polycarboxylic acid to a polycondensation reaction.

Dihydric alcohols (DIO), and tri- or more-hydric alcohols (TO) can be used as the polyalcohol (PO). Among these polyalcohols, dihydric alcohols, or combinations of a dihydric alcohol and a small amount of a tri- or more-hydric alcohol can be preferably used.

Specific examples of such dihydric alcohols (DIO) include alkylene glycols such as ethylene glycol, 1,2-propylene glycol, 1,3-propylene glycol, 1,4-butane diol, and 1,6-hexane diol; alkylene ether glycols such as diethylene glycol, triethylene glycol, dipropylene glycol, polyethylene glycol, polypropylene glycol, and polytetramethylene ether glycol; alicyclic diols such as 1,4-cyclohexane dimethanol, and hydrogenated bisphenol A; bisphenol compounds such as bisphenol A, bisphenol F, and bisphenol S; alkylene oxide (such as ethylene oxide, propylene oxide, and butylene oxide) adducts of the alicyclic diols; and alkylene oxide (such as ethylene oxide, propylene oxide, and butylene oxide) adducts of the bisphenol compounds.

Among these dihydric alcohols, alkylene glycols having 2 to 12 carbon atoms, and alkylene oxide adducts of bisphenol compounds are preferable, and alkylene oxide adducts of bisphenol compounds, and combinations of an alkylene oxide adduct of a bisphenol compound and an alkylene glycol having 2 to 12 carbon atoms are more preferable.

Specific examples of the tri- or more-hydric alcohols (TO) include aliphatic alcohols having three or more hydroxyl groups such as glycerin, trimethylol ethane, trimethylol propane, pentaerythritol, and sorbitol; polyphenols having three or more hydroxyl groups such as trisphenol PA, phenol novolac, and cresol novolac; and alkylene oxide (such as ethylene oxide, propylene oxide, and butylene oxide) adducts of the polyphenols.

Dicarboxylic acids (DIC) and polycarboxylic acids (TC) having three or more carboxyl groups are used as the polycarboxylic acid (PC). Among these polycarboxylic acids, dicarboxylic acids, or combinations of a dicarboxylic acid and a small amount of a polycarboxylic having three or more carboxyl groups acid are preferable.

Specific examples of the dicarboxylic acids (DIC) include alkylene dicarboxylic acids such as succinic acid, adipic acid, and sebacic acid; alkenylene dicarboxylic acids such as maleic acid, and fumaric acid; and aromatic dicarboxylic acids such as phthalic acid, isophthalic acid, terephthalic acid, and naphthalene dicarboxylic acids. Among these dicarboxylic acids, alkenylene dicarboxylic acids having from 4 to 20 carbon atoms, and aromatic dicarboxylic acids having from 8 to 20 carbon atoms are preferably used.

Specific examples of the polycarboxylic acids (TC) having three or more carboxyl groups include aromatic polycarboxylic acids having from 9 to 20 carbon atoms such as trimellitic acid, and pyromellitic acid.

Anhydrides and lower alkyl esters (such as methyl esters, ethyl esters and isopropyl esters) of the above-mentioned polycarboxylic acids can also be used for the polycarboxylic acid (PC).

Suitable mixing ratio of a polyalcohol (PO) to a polycarboxylic acid (PC) (i.e., an equivalence ratio [OH]/[COOH]) of the hydroxyl group of the polyalcohol to the carboxyl group of the polycarboxylic acid) is from 2/1 to 1/1, preferably from 1.5/1 to 1/1, and more preferably from 1.3/1 to 1.02/1.

The polycondensation reaction of a polyalcohol (PO) with a polycarboxylic acid (PC) is performed, for example, by a method in which the components are heated to a temperature of from 150 to 280° C. in the presence of a known esterification catalyst such as tetrabutoxy titanate and dibutyltin oxide while optionally removing generated water under a reduced pressure to prepare a polyester resin having a hydroxyl group.

The polyester preferably has a hydroxyl value of not less than 5 mgKOH/g, and an acid value of from 1 to 30 mgKOH/g, and preferably from 5 to 20 mgKOH/g.

When a polyester having an acid value is used, the resultant toner can have a negative charging property. In addition, the toner has good affinity for recording papers, resulting in enhancement of the low temperature fixability of the toner. However, when the acid value is greater than 30 mgKOH/g, stability of the charging property of the toner deteriorates particularly when the environmental conditions change.

The weight average molecular weight of the polyester is from 10,000 to 400,000, and preferably from 20,000 to 200,000. When the weight average molecular weight is less than 10,000, the offset resistance of the toner tends to deteriorate. In contrast, when the weight average molecular weight is greater than 400,000, the low temperature fixability of the toner tends to deteriorate.

Urea-modified polyesters can also be preferably used as the polyester as well as the above-mentioned unmodified polyesters prepared by a polycondensation reaction. Urea-modified polyesters can be prepared by reacting a polyisocyanate compound (PIC) with a carboxyl group or a hydroxyl group present at the end of the above-mentioned unmodified polyester to prepare a polyester prepolymer (A) having an isocyanate group, and then reacting an amine compound with the prepolymer (A) to perform a crosslinking reaction and/or a polymer chain growth reaction.

Specific examples of the polyisocyanate compounds (PIC) include, but are not limited thereto, aliphatic polyisocyanates (such as tetramethylene diisocyanate, hexamethylene diisocyanate, and 2,6-diisocyanato methylcaproate); alicyclic polyisocyanates (such as isophorone diisocyanate, and cyclohexylmethane diisocyanate); aromatic diisocyanates (such as tolylene diisocyanate, and diphenylmethane diisocyanate); aromatic aliphatic diisocyanates (such as $\alpha,\alpha,\alpha',\alpha'$-tetramethyl xylylene diisocyanate); isocyanurates; and blocked isocyanates such as polyisocyanates blocked with a phenol derivative, an oxime, or a caprolactam. These compounds can be used alone or in combination.

When synthesizing a polyester prepolymer (A) having an isocyanate group, suitable mixing ratio of a polyisocyanate to a polyester having a hydroxyl group (i.e., an equivalence ratio [NCO]/[OH] of the isocyanate group of a polyisocyanate (PIC) to the hydroxyl group of a polyester) is from 5/1 to 1/1, preferably from 4/1 to 1.2/1, and more preferably from 2.5/1 to 1.5/1. When the ratio [NCO]/[OH] is greater than 5/1, the low temperature fixability of the toner tends to deteriorate. In contrast, when the ratio [NCO]/[OH] is less than 1/1, the urea content of the urea-modified polyester decreases, resulting in deterioration of the hot offset resistance of the toner. The content of the unit obtained from the polyisocyanate in the polyester prepolymer (A) having a polyisocyanate group is from 0.5 to 40% by weight, preferably from 1 to 30% by weight, and more preferably from 2 to 20% by weight.

When the content is less than 0.5% by weight, the hot offset resistance of the toner tends to deteriorate, and in addition it is hard to impart a good combination of high temperature fixability and low temperature fixability to the toner. In contrast, when the content is greater than 40% by weight, the low temperature fixability of the toner tends to deteriorate.

The number of the isocyanate group in a polyester prepolymer (A) is generally not less than 1, preferably from 1.5 to 3 in average, and more preferably from 1.8 to 2.5 in average. When the number is less than 1, the molecular weight of the urea-modified polyester decreases, resulting in deterioration of the hot offset resistance of the toner.

By reacting an amine with the polyester prepolymer (A), a urea-modified polyester resin can be prepared. Specific examples of such an amine include diamines (B1), polyamines (B2) having three or more amino groups, amino alcohols (B3), amino mercaptans (B4), amino acids (B5), and blocked amines in which amino groups of the above-mentioned amine compounds B1-B5 are blocked.

Specific examples of the diamines (B1) include aromatic diamines (such as phenylene diamine, diethyltoluene diamine, and 4,4'-diaminodiphenyl methane); alicyclic diamines (such as 4,4'-diamino-3,3'-dimethyldicyclohexyl methane, diaminocyclohexane, and isophorone diamine); and aliphatic diamines (such as ethylene diamine, tetramethylene diamine, and hexamethylene diamine).

Specific examples of the polyamines (B2) having three or more amino groups include diethylene triamine, and triethylene tetramine. Specific examples of the amino alcohols (B3) include ethanol amine, and hydroxyethyl aniline. Specific examples of the amino mercaptans (B4) include aminoethyl mercaptan, and aminopropyl mercaptan. Specific examples of the amino acids (B5) include amino propionic acid, and amino caproic acid. Specific examples of the blocked amines (B6) include ketimine compounds obtained from the amines B1-B5 and ketones such as acetone, methyl ethyl ketone and methyl isobutyl ketone, and oxazolidine compounds.

Among these amine compounds (B), diamines (B1) and combinations of a diamine (B1) and a small amount of polyamine (B2) are preferable.

The mixing ratio of a polyester prepolymer (A) having an isocyanate group to an amine compound (B) (i.e., an equivalence ratio [NCO]/[NHx] of the isocyanate group of a polyester prepolymer (A) to the amino group of an amine (B)) is from 1/2 to 2/1, preferably from 1/1.5 to 1.5/1, and more preferably from 1/1.2 to 1.2/1. When the ratio is greater than 2/1 or less than 1/2, the molecular weight of the urea-modified polyester decreases, resulting in deterioration of the hot offset resistance of the toner.

The urea-modified polyester can include a urethane bond as well as a urea bond. The molar ratio of the urea bond to the urethane bond is from 100/0 to 10/90, preferably from 80/20 to 20/80, and more preferably from 60/40 to 30/70. When the molar ratio of the urea bond is less than 10%, the hot offset resistance of the toner tends to deteriorate.

Urea-modified polyester can be prepared by a one shot method or the like. Specifically, in the method, a polyalcohol (PO) and a polycarboxylic acid (PC) are heated to a temperature of form 150 to 280° C. in the presence of an esterification catalyst such as tetrabutoxy titanate and dibutyltin oxide while optionally removing generated water at a reduced pressure to prepare a polyester resin having a hydroxyl group. Next, the polyester is reacted with a polyisocyanate (PIC) at a temperature of from 40 to 140° C. to prepare a polyester prepolymer (A) having an isocyanate group. Further, the polyester prepolymer (A) is reacted with an amine compound (B) at a temperature of from 0 to 140° C. to prepare a urea-modified polyester.

When an isocyanate compound (PIC) is reacted or when a polyester prepolymer (A) is reacted with an amine compound (B), a solvent can be used if desired. Specific examples of the solvent include solvents inactive with an isocyanate compound (PIC) such as aromatic solvents (e.g., toluene and xylene); ketones (e.g., acetone, methyl ethyle ketone, and methyl isobutyl ketone); esters (e.g., ethyl acetate); amides (e.g., dimethylformamide, and dimethylacetamide); and ethers (e.g., tetrahydrofuran).

When a polyester prepolymer (A) and an amine (B) are subjected to a crosslinking reaction and/or a polymer chain growth reaction, a reaction terminator can be used for at least one of the reactions, if desired, to control the molecular weight of the urea-modified polyester. Specific examples of such a reaction terminator include monoamines such as diethylamine, dibutylamine, butylamine, laurylamine, and blocked monoamines such as ketimine compounds in which the above-mentioned monoamines are blocked with a ketone compound.

The weight average molecular weight of the urea-modified polyester is not less than 10,000, preferably from 20,000 to 10,000,000, and more preferably from 30,000 to 1,000,000. When the weight average molecular weight is less than 10,000, the hot offset resistance of the toner deteriorates.

The number average molecular weight of the urea-modified polyester resin is not particularly limited if the above-mentioned unmodified polyester is used in combination, and importance is attached to the weight average molecular weight. When a urea-modified polyester is used alone, the number average molecular weight thereof is from 2,000 to 15,000, preferably from 2,000 to 10,000, and more preferably from 2,000 to 8,000. When the number average molecular weight is greater than 20,000, the low temperature fixability of the toner tends to deteriorate, and glossiness of toner images tends to deteriorate when the toner is used for full color image forming apparatuses.

It is preferable to use a combination of an unmodified polyester and a urea-modified polyester, because the low temperature fixability of the toner can be enhanced, and in addition the glossiness of toner images can be enhanced when the toner is used for full color image forming apparatuses. In this regard, the unmodified polyester resin can include a chemical bond other than a urea bond.

When a combination of an unmodified polyester and a urea-modified polyester is used, the polyesters are preferably compatible with each other at least partially to impart a good combination of low temperature fixability and hot offset resistance to the toner. Therefore, it is preferable that the unmodified polyester and the urea-modified polyester used in combination are similar in composition.

The weight ratio of an unmodified polyester to a urea-modified polyester is from 20/80 to 95/5, preferably from 70/30 to 95/5, more preferably from 75/25 to 95/5, and even more preferably from 80/20 to 93/7. When the content of a urea-modified polyester is less than 5% by weight, the hot offset resistance of the toner tends to deteriorate, and it is hard to impart a good combination of high temperature preservability and low temperature fixability to the toner.

The binder resin of the toner, which includes an unmodified polyester and a urea-modified polyester, preferably has a glass transition temperature (Tg) of from 45 to 65° C., and preferably from 45 to 60° C. When the Tg is lower than 45° C., the heat resistance of the toner tends to deteriorate. When the Tg is higher than 65° C., the low temperature fixability of the toner tends to deteriorate.

Since a urea-modified polyester tends to be present in a surface portion of toner particles, a better high temperature preservability can be imparted to the toner than in a case in which a general polyester is used as a binder resin of toner even when the glass transition temperature of the urea-modified polyester is relatively low.

(Colorant)

Suitable materials for use as the colorant of the toner include known dyes and pigments. Specific examples of such dyes and pigments include carbon black, Nigrosine dyes, black iron oxide, NAPHTHOL YELLOW S, HANSA YELLOW 10G, HANSA YELLOW 5G, HANSA YELLOW G, Cadmium Yellow, yellow iron oxide, loess, chrome yellow, Titan Yellow, polyazo yellow, Oil Yellow, HANSA YELLOW GR, HANSA YELLOW A, HANSA YELLOW RN, HANSA YELLOW R, PIGMENT YELLOW L, BENZIDINE YEL- LOW G, BENZIDINE YELLOW GR, PERMANENT YELLOW NCG, VULCAN FAST YELLOW 5G, VULCAN FAST YELLOW R, Tartrazine Lake, Quinoline Yellow LAKE, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED F2R, PERMANENT RED F4R, PERMANENT RED FRL, PERMANENT RED FRLL, PERMANENT RED F4RH, Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE RS, INDANTHRENE BLUE BC, Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

The content of such a colorant in the toner is preferably from 1 to 15% by weight, and more preferably from 3 to 10% by weight of the toner.

Master batches, which are complexes of a colorant with a resin (binder resin), can be used as the colorant of the toner. Specific examples of the resin for use in the master batches include homopolymers of styrene or styrene derivatives such as polystyrene, poly-p-chlorostyrene, and polyvinyl toluene; copolymers of styrene and vinyl compounds; polymethyl methacrylate, polybutyl methacrylate, polyvinyl chloride, polyvinyl acetate, polyethylene, polypropylene, polyester, epoxy resins, epoxy polyol resins, polyurethane, polyamide, polyvinyl butyral, polyacrylic acid resins, rosin, modified rosins, terpene resins, aliphatic or alicyclic hydrocarbon resins, aromatic petroleum resins, chlorinated paraffin, and paraffin waxes. These resins can be used alone or in combination.

(Charge Controlling Agent)

Any known charge controlling agents can be used for the toner. Suitable materials for use as the charge controlling agent include Nigrosine dyes, triphenyl methane dyes, chromium-containing metal complex dyes, molybdic acid chelate pigments, Rhodamine dyes, alkoxyamines, quaternary ammonium salts (including fluorine-modified quaternary ammonium salts), alkylamides, phosphor and its compounds, tungsten and its compounds, fluorine-containing surfactants, metal salts of salicylic acid, metal salts of salicylic acid derivatives, copper phthalocyanine, perylene, quinacridone, azo pigments, and polymers having a functional group such as a sulfonate group, a carboxyl group, and a quaternary ammonium salt group.

Specific examples of marketed charge controlling agents include BONTRON 03 (Nigrosine dye), BONTRON P-51 (quaternary ammonium salt), BONTRON S-34 (metal-containing azo dye), BONTRON E-82 (metal complex of oxynaphthoic acid), BONTRON E-84 (metal complex of salicylic acid), and BONTRON E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE PR (triphenyl methane derivative), COPY CHARGE NEG VP2036 and COPY CHARGE NX VP434 (quaternary ammonium salt), which are manufactured by Hoechst AG; and LRA-901 and LR-147 (boron complex), which are manufactured by Japan Carlit Co., Ltd.

Among these charge controlling agents, materials capable of negatively charging the toner are preferable.

The added amount of such a charge controlling agent is determined depending on choice of binder resin, presence or absence of additives, and the toner preparation method including the dispersing method, and is not unambiguously determined. However, the added amount is preferably from 0.1 to 10 parts by weight, and more preferably from 0.2 to 5 parts by weight, based on 100 parts by weight of the binder resin. When the added amount is greater than 10 parts by weight, the toner tends to have an excessively large charge property, thereby increasing electrostatic attraction between the toner and a developing roller, resulting in deterioration of fluidity of the toner (developer) and decrease of image density.

(Release Agent)

Waxes having a low melting point of from 50 to 120° C. are preferably used because such a wax satisfactorily serves as a release agent when being dispersed in a binder resin, and when a toner image is fixed, the release agent is present between a fixing roller and the toner image, thereby enhancing the hot offset resistance of the toner. Therefore, the toner can be used without applying a release agent such as oils to the fixing roller.

Specific examples of the release agent for use in the toner include, but are not limited thereto, vegetable waxes such as carnauba waxes, cotton waxes, Japan waxes, and rice waxes; animal waxes such as bees waxes, and lanolin; mineral waxes such as ozocerite and ceresin waxes; petroleum waxes such as paraffin waxes, microcrystalline waxes, and petrolatum; synthesized hydrocarbon waxes such as Fischer-Tropsch waxes, and polyethylene waxes; synthesized waxes such as esters, ketones and ethers; amides and imides such as 12-hydroxystearamide, stearamide, and phthalic anhydride imide; chlorinated hydrocarbons; and low molecular weight crystalline polymers having a long alkyl group in a side chain thereof such as homopolymers or copolymers of polyacrylate (e.g., poly(n-stearyl methacrylate), poly(n-lauryl methacrylate), and n-stearyl acrylate-ethyl methacrylate copolymers.

The charge controlling agent and the release agent can be melted and kneaded together with the master batch and the binder resin when the toner is prepared by a dry method. Alternatively, the components may be dissolved or dispersed in an organic solvent when the toner is prepared by a wet method.

(External Additive)

In order to enhance the fluidity, the developing property and the charge property of toner particles, a particulate inorganic material can be used as an external additive of the toner. Such a particulate inorganic material preferably has an average primary particle diameter of from 5 nm to 2 μm, and more preferably from 5 nm to 500 nm. The BET specific surface area of the particulate inorganic material is preferably from 20 to 500 $m^2/g$. The content of such a particulate inorganic material in the toner is generally from 0.01 to 5.0% by weight, and preferably from 0.01 to 2.0% by weight.

Specific examples of the particulate inorganic material include, but are not limited thereto, silica, alumina, titanium oxide, barium titanate, magnesium titanate, calcium titanate, strontium titanate, zinc oxide, tin oxide, quartz sand, clay, mica, wollastonite, diatom earth, chromium oxide, cerium oxide, red iron oxide, antimony trioxide, magnesium oxide, zirconium oxide, barium oxide, barium carbonate, calcium carbonate, silicon carbide, and silicon nitride. These materials can be used alone or in combination.

Among these particulate inorganic materials, combinations of a hydrophobized particulate silica and a hydrophobized particulate titanium oxide are preferably used. Particularly, when a particulate material having an average particle diameter of not greater than 500 nm is mixed with toner particles while agitated, the electrostatic force and van der Waals attraction between the inorganic material and the toner particles are dramatically enhanced. Therefore, even when the toner is agitated in a developing device to charge the toner so as to have the desired charge quantity, the inorganic material is not released from the toner particles. Therefore, high quality images can be produced by the toner without forming defective images such as images having omissions therein while the amount of residual toner particles is reduced. Particulate titanium oxides have good environmental stability and impart good image density stability to the toner, but tend to deteriorate the charge rising property of the toner. Therefore, when the added amount of a titanium oxide is greater than that of a silica, the charge rising property of the toner tends to deteriorate.

However, when the added amount of such a combination external additive including a hydrophobized silica and a hydrophobized titanium oxide is in a range of from 0.3 to 1.5% by weight, the charge rising property of the toner does not deteriorate, and the desired charge rising property can be imparted to the toner. Namely, even when image forming operations are repeatedly performed using the toner, high quality images can be produced stably.

Next, the method for preparing the toner will be described. The following method is a preferable method, but the toner preparation method is not limited thereto.

(Toner Preparation Method)

(1) Initially, a colorant, an unmodified polyester, a polyester prepolymer having an isocyanate group, and a release agent are dispersed in an organic solvent to prepare a toner component liquid.

The organic solvent preferably has a boiling point of not higher than 100° C. so that the solvent can be easily removed after toner particles are prepared. Specific examples of the organic solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These organic solvents can be used alone or in combination. Among these organic solvents, aromatic solvents such as toluene, and xylene, and halogenated hydrocarbons such as methylene chloride, 1,2-dichloroethane, chloroform and carbon tetrachloride are preferable. The amount of the organic solvent is from 0 to 300 parts by weight, preferably from 0 to 100 parts by weight, and more preferably from 25 to 70 parts by weight, based on 100 parts by weight of the polyester prepolymer used.

(2) The toner component liquid is emulsified in an aqueous medium in the presence of a surfactant, and a particulate resin.

Water is typically used as the aqueous medium, and the aqueous medium can optionally include an organic solvent such as alcohols (e.g., methanol, isopropyl alcohol, and ethylene glycol), dimethylformamide, tetrahydrofuran, cellosolves (e.g., methyl cellosolve), and lower ketones (e.g., acetone and methyl ethyl ketone).

The amount of the aqueous medium is generally from 50 to 2,000 parts by weight, and preferably from 100 to 1,000 parts by weight, based on 100 parts by weight of the toner component liquid. When the amount of the aqueous medium is less than 50 parts by weight, it is hard to satisfactorily disperse the toner component liquid in the aqueous medium. In contrast, using an aqueous medium in an amount of greater than 20,000 parts by weight is not economical.

In order to satisfactorily disperse the toner component liquid in the aqueous medium, a dispersant such as surfactants and particulate resins can be added in the aqueous medium.

Suitable materials for use as the surfactant include anionic surfactants such as alkylbenzenesulfonic acid salts, α-olefin sulfonic acid salts, and phosphoric acid salts; cationic surfactants such as amine salts (e.g., alkyl amine salts, amino alcohol fatty acid derivatives, polyamine fatty acid derivatives, and imidazoline), and quaternary ammonium salts (e.g., alkyltrimethyl ammonium salts, dialkyldimethyl ammonium salts, alkyldimethylbenzyl ammonium salts, pyridinium salts, alkylisoquinolinium salts, and benzethonium chloride); nonionic surfactants such as fatty acid amide derivatives, and polyalcohol derivatives; and ampholytic surfactants such as alanine, dodecylbis(aminoethyl)glycin, bis(octylaminoethyl-e)glycin, and N-alkyl-N,N-dimethylammonium betaine.

By using a surfactant having a fluoroalkyl group, the effect can be produced even when the added amount of the surfactant is small.

Specific examples of the anionic surfactants having a fluoroalkyl group include fluoroalkyl(C2-10) carboxylic acids and their metal salts, disodium perfluorooctanesulfonylglutamate, sodium 3-{ω-fluoroalkyl(C6-C11)oxy}-1-alkyl (C3-C4) sulfonates, sodium 3-{ω-fluoroalkanoyl(C6-C8)-N-ethylamino}-1-propanesulfonates, fluoroalkyl(C11-C20) carboxylic acids and their metal salts, perfluoroalkyl(C7-C13)carboxylic acids and their metal salts, perfluoroalkyl (C4-C12)sulfonates and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10)-N-ethylsulfonyl glycin, and monoperfluoroalkyl(C6-C16)ethylphosphates.

Specific examples of marketed products of such anionic surfactants having a fluoroalkyl group include SARFRON S-111, S-112 and S-113, which are manufactured by Asahi Glass Co., Ltd.; FLUORAD FC-93, FC-95, FC-98 and FC-129, which are manufactured by Sumitomo 3M Ltd.; UNIDYNE DS-101 and DS-102, which are manufactured by Daikin Industries, Ltd.; MEGAFACE F-110, F-120, F-113, F-191, F-812 and F-833 which are manufactured by DIC Corp.; ECTOP EF-102, 103, 104, 105, 112, 123A, 123B, 306A, 501, 201 and 204, which are manufactured by Tohchem Products Co., Ltd.; FUTARGENT F-100 and F150 manufactured by Neos Co., Ltd.; etc.

Specific examples of the cationic surfactants having a fluoroalkyl group include primary, secondary and tertiary aliphatic amino acids, aliphatic quaternary ammonium salts such as propyltrimethylammonium salts of perfluoroalkyl (C6-C10)sulfoneamide, benzalkonium salts, benzethonium chloride, pyridinium salts, and imidazolinium salts, all of which have a fluoroalkyl group.

Specific examples of marketed products of such cationic surfactants having a fluoroalkyl group include SARFRON S-121 (from Asahi Glass Co., Ltd.); FLUORAD FC-135

(from Sumitomo 3M Ltd.); UNIDYNE DS-202 (from Daikin Industries, Ltd.); MEGAFACE F-150 and F-824 (from DIC Corp.); ECTOP EF-132 (from Tohchem Products Co., Ltd.); and FUTARGENT F-300 (from Neos Co., Ltd.).

In order to stabilize toner particles, which are formed in the aqueous medium, a particulate resin is added to the aqueous medium. Such a particulate resin is preferably added in an amount such that the surface of the toner particles is covered with the particulate resin at a covering rate of from 10 to 90%. Specific examples of such a particulate resin include particulate polymethyl methacrylate having a particle diameter of 1 μm or 4 μm, particulate polystyrene having a particle diameter of 0.5 μm or 2 μm, and particulate poly(styrene-acrylonitrile) having a particle diameter of 1 μm. Specific examples of marketed products of such particulate resins include PB-200H (from Kao Corp.), SGP and SGP-30 (from Soken Chemical & Engineering Co., Ltd.), and TECHNOPOLYMER SB and MICROPEARL (from Sekisui Chemical Co., Ltd.).

In addition, inorganic dispersants such as tricalcium phosphate, calcium carbonate, titanium oxide, colloidal silica, and hydroxyapatite can also be used.

Polymeric protection colloids can also be used as the dispersant in combination with such an inorganic dispersant. Specific examples of such polymeric protection colloids include polymers and copolymers prepared by using monomers such as monomers having a carboxyl group (e.g., acrylic acid, methacrylic acid, α-cyanoacrylic acid, α-cyanomethacrylic acid, itaconic acid, crotonic acid, fumaric acid, maleic acid, and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, glycerinmonomethacrylic acid esters, N-methylolacrylamide, and N-methylolmethacrylamide), vinyl alkyl ethers (e.g., vinyl methyl ether, vinyl ethyl ether, and vinyl propyl ether), esters of vinyl alcohol with a compound having a carboxyl group (e.g., vinyl acetate, vinyl propionate, and vinyl butyrate), amides and methylol compounds thereof (e.g, acrylamide, methacrylamide, and diacetoneacrylamide acids), monomers having a chlorocarbonyl group (e.g., acrylic acid chloride, and methacrylic acid chloride), and monomers having a nitrogen atom or an alicyclic ring having a nitrogen atom (e.g., vinyl pyridine, vinyl pyrrolidone, vinyl imidazole, and ethylene imine).

In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose, and hydroxypropyl cellulose, can also be used as the polymeric protective colloid.

Known mixers and dispersing machines such as low speed shearing type dispersing machines, high speed shearing type dispersing machines, friction type dispersing machines, high pressure jet type dispersing machines, and ultrasonic dispersing machine can be used for dispersing the toner component liquid in the aqueous medium. Among these dispersing machines, high speed shearing type dispersing machines are preferably used in order to prepare a dispersion including particles having an average particle diameter of from 2 to 20 μm.

When high shearing type dispersing machines are used, the rotation speed of rotors is not particularly limited, but the rotation speed is generally from 1,000 to 30,000 rpm and preferably from 5,000 to 20,000 rpm. In addition, the dispersing time is also not particularly limited, but the dispersing time is generally from 0.1 to 5 minutes. The temperature in the dispersing process is generally 0 to 150° C. (under pressure), and preferably from 40 to 98° C.

(3) When preparing the emulsion, an amine (B) is added thereto to react the amine with the polyester prepolymer (A) having an isocyanate group. In this reaction, a crosslinking reaction and/or a polymer chain growth reaction is performed. The reaction time is determined depending on the reactivity of the isocyanate of the prepolymer (A) used with the amine used. However, the reaction time is typically from 10 minutes to 40 hours, and preferably from 2 hours to 24 hours. The reaction temperature is typically from 0 to 150° C. and preferably from 40 to 98° C. In addition, known catalysts such as dibutyltin laurate and dioctyltin laurate can be added, if desired, when the reaction is performed.

(4) After the reaction is completed, the organic solvent is removed from the emulsified dispersion (i.e., reaction product), and the resultant particles are washed and dried to prepare toner particles. In order to remove the organic solvent, the reaction product is gradually heated while agitated to form a laminar flow, and then the reaction product is heated in a temperature range while agitated strongly to remove the organic solvent, thereby forming toner particles having a spindle form. In this regard, when a dispersion stabilizer soluble in acids and alkalis such as calcium phosphate is used, calcium phosphate adhered to the toner particles is dissolved by an acid such as hydrochloric acid, and then the toner particles are washed with water to remove calcium phosphate from the toner particles. In addition, such a dispersion stabilizer can be removed by a decomposition method using an enzyme.

(5) Next, a charge controlling agent is attached to the thus prepared toner particles, and a particulate inorganic material such as silica and titanium oxide is added to the toner particles as an external additive, resulting in formation of a toner. Attachment of the charge controlling agent and the particulate inorganic material is performed by a known method using a mixer or the like.

By using this method, toner having a small average particle diameter and a sharp particle diameter distribution can be easily prepared. In addition, by performing agitation while controlling the agitation strength in the organic solvent removing process, the shape of the toner particles can be freely changed so as to be from a spherical shape to a rugby ball shape. In addition, the surface of the toner particles can also be freely changed so as to be from a smooth surface to a wrinkled surface.

The shape of particles of the toner is a nearly-spherical shape, and is represented by the below-mentioned method.

Figure 15A:
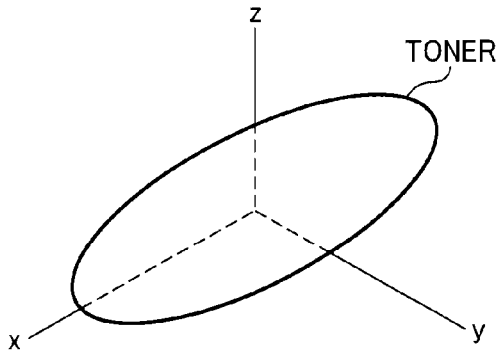
FIGS. 15A-15C are schematic views illustrating a toner particle from different directions.
Figure 15B:
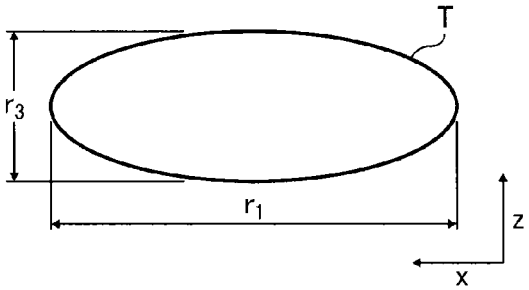
Figure 15C:
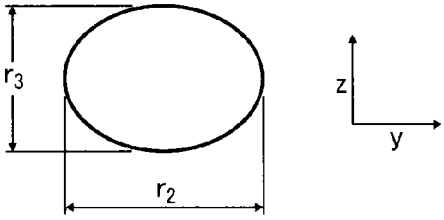

FIGS. 15A-15C are schematic views illustrating a toner particle having a nearly-spherical shape. Referring to FIGS. 15A-15C, the toner particle has a long axis r1, a short axis r2 and a thickness r3, wherein $r1 \geq r2 \geq r3$. The toner preferably has a ratio r2/r1 of from 0.5 to 1.0, and a ratio r3/r2 of from 0.7 to 1.0. When the ratio r2/r1 is less than 0.5, the shape is largely different from a spherical shape, and therefore dot reproducibility and transfer efficiency of the toner deteriorate, thereby making it impossible to form high quality images. When the ratio r3/r2 is less than 0.7, the shape becomes a flat shape, and therefore the toner has a low transfer efficiency unlike spherical toner. When the ratio r3/r2 is 1.0, the toner particles can rotate on the long axis, and therefore the toner has excellent fluidity.

The lengths and thickness r1, r2 and r3 are measured by a method in which a toner particle is observed with a scanning electron microscope (SEM) while changing the viewing angle.

Figure 16:
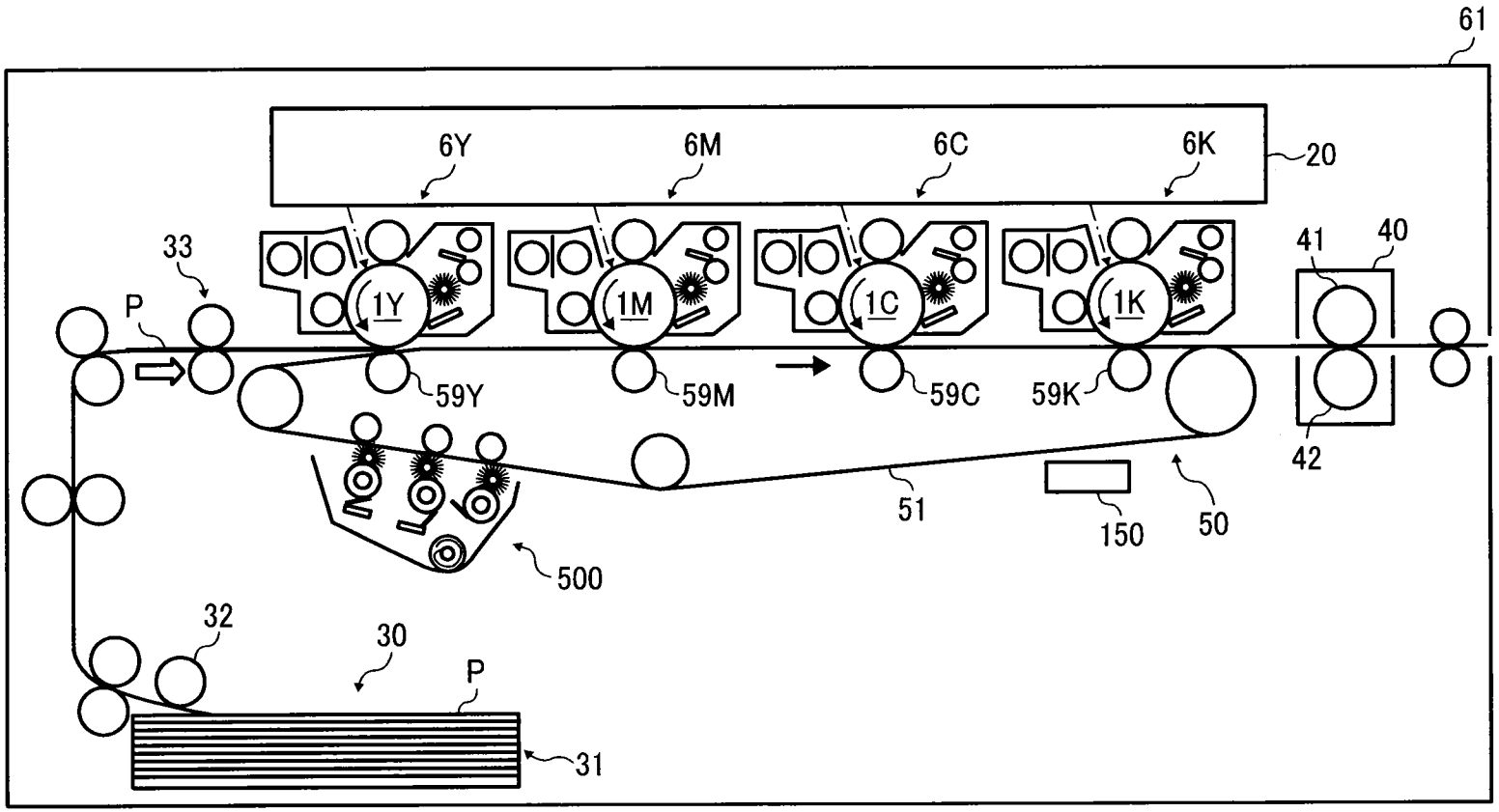
FIG. 16 is a schematic view illustrating a main portion of a tandem type direct transfer printer as an image forming apparatus according to an embodiment.

FIG. 16 illustrates a direct transfer type tandem printer 61. The above-mentioned belt cleaner 100 and the voltage setting device (i.e., the controller 136) can also be used for a feeding belt cleaner 500 to clean the surface of a feeding belt 51 of a recording medium feeding device 50 illustrated in FIG. 16.

In the tandem-type printer 61 illustrated in FIG. 16, the feeding belt 51 to feed the recording medium P is contacted with the photoreceptors 1Y, 1M, 1C and 1K by four primary transfer rollers 59Y, 59M, 59C and 59K to form four primary transfer nips for transferring Y, M, C and K toner images. The feeding belt 51 feeds the recording medium P from left to right so that the recording medium P passes through the Y, M, C and K primary transfer nips in this order, resulting in transferring of the Y, M, C and K toner images onto the recording medium P. After the K toner image is primarily transferred onto the recording medium P, foreign materials such as toner particles on the feeding belt 51 are removed therefrom by the feeding belt cleaner 500. In addition, the optical sensor unit 150 is provided so as to be opposed to the outer surface of the feeding belt 51 with a predetermined distance.

In the printer 61 illustrated in FIG. 16, the image density controlling operation and the misalignment correction operation mentioned above are performed at a predetermined time. Specifically, a toner test pattern is formed on the feeding belt 51, and the toner test pattern (such as half tone pattern and chevron patch) is detected by the optical sensor unit 150, followed by performing the correction operations based on the detection results. After the detection operation, the toner test pattern is removed from the feeding belt 51 by the feeding belt cleaner 500. Thus, the feeding belt 51 also serves as a toner image bearing member.

By applying the configuration and the applied voltage control of the belt cleaner 100 to the feeding belt cleaner 500, a toner test pattern formed on the feeding belt 51 can be satisfactorily removed therefrom, and therefore occurrence of a problem in that the backside of the recording medium P is contaminated by residual toner particles can be prevented.

Figure 17:
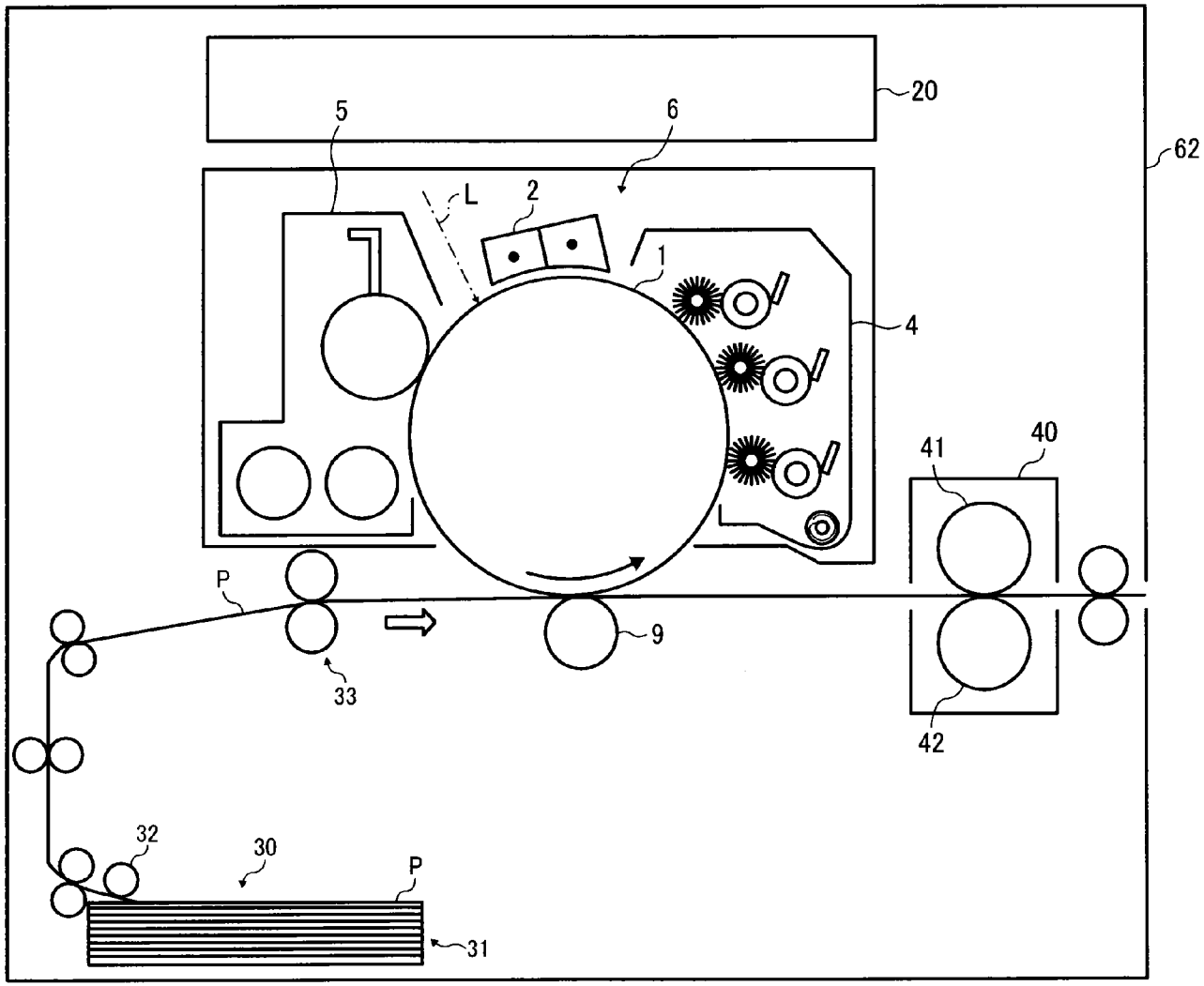
FIG. 17 is a schematic view illustrating a main portion of a monochromatic printer as an image forming apparatus according to an embodiment.

FIG. 17 is a schematic view illustrating a printer 62 that forms a monochromatic image. The configuration and the applied voltage control of the belt cleaner 100 can be applied to a drum cleaner 4 that cleans the surface of the photoreceptor drum 1. In this regard, the shape of the photoreceptor 1 is not limited to the drum shape, and a belt-shaped photoreceptor can also be used.

When a refresh mode is performed on the printer 62 to refresh the developing device 5, or when jamming of a recording medium sheet is caused in the printer 62 and a non-transferred toner image remains on the photoreceptor 1, the non-transferred toner image is input to the drum cleaner 4. Even in such a case, the drum cleaner 4, to which the configuration and the applied voltage control of the belt cleaner 100 are applied, can satisfactorily remove the non-transferred toner image from the surface of the photoreceptor 1.

The present application is not limited to the above-mentioned examples. The present application includes the following embodiments, which produce the following specific effects.

Embodiment A

The cleaner of this disclosure (such as the belt cleaner 100) includes at least two cleaning brush members (such as the cleaning brush rollers 101, 104 and 107) to electrostatically remove toner (such as residual toner particles and a non-transferred toner image) on an object to be cleaned (such as the intermediate transfer belt 8); a memory (such as the memory 137) to store information on setup voltage values; a voltage applicator (such as the power sources 130*a*-135*a*) to apply voltages to the cleaning brush members based on the setup voltage values stored in the memory; a current detector (such as the current detectors 130*b*-135*b*) to detect the amounts of currents flowing through the contact portions of the object with the cleaning brush members; and a setup voltage changing device (such as the controller 136) to change the setup voltage values based on the amounts of currents detected by the current detector.

In this cleaner, the setup voltage changing device changes the setup voltage values for all the cleaning brush members at the same time. By using this method, the setup voltage changing process can be completed in a shorter time than in a case in which the setup voltage changing device changes the setup voltage values for the cleaning brush members one by one.

Embodiment B

In the cleaner mentioned above in Embodiment A, three cleaning brush members are used as the cleaning brush members. The three cleaning brush members include a first cleaning brush member (such as the pre-cleaning brush roller 101), to which a voltage having a polarity opposite to the normal charge polarity of the toner is applied to electrostatically remove normally-charged toner on the surface of the object to be cleaned; a second cleaning brush member (such as the reversely-charged toner cleaning brush roller 104), which is arranged on a downstream side from the first cleaning brush member relative to the moving direction of the object and to which a voltage having the same polarity as the normal charge polarity of the toner is applied to remove reversely-charged toner on the surface of the object; and a third cleaning brush member (such as the normally-charged toner cleaning brush roller 107), which is arranged on a downstream side from the second cleaning brush member relative to the moving direction of the object and to which a voltage having a polarity opposite to the normal charge polarity of the toner is applied to electrostatically remove normally-charged toner on the surface of the object.

Since a greater part of the non-transferred toner image is normally-charged toner particles, the normally-charged toner particles are largely removed by the first cleaning brush member, and therefore the amount of residual toner fed to the second and third cleaning brush members is small. Therefore, the second and third cleaning brush members can easily remove residual toner from the object to be cleaned, thereby preventing occurrence of defective cleaning.

Embodiment C

In the cleaner mentioned above in Embodiment B, the voltage applicator applies a voltage to the first cleaning brush roller while changing the voltage level in at least two levels including a first voltage for removing residual toner particles and a second voltage for removing a non-transferred toner image. In this case, the residual toner particles and the non-transferred toner image can be satisfactorily removed from the object to be cleaned.

Embodiment D

The image forming apparatus of Embodiment D (such as the printer 60 illustrated in FIG. 2) includes an image bearing member (such as the photoreceptor 1); a toner image forming device (such as the combination of the charger 2, the optical writing unit 20, and the developing device 5) to form a toner image on the image bearing member; a primary transferring device (such as the primary transfer roller 9) to transfer the toner image onto an intermediate transfer medium (such as the intermediate transfer belt 8); a secondary transferring device (such as the secondary transfer roller 18) to transfer the toner image on the intermediate transfer medium to a recording medium; and a cleaner to remove residual toner on the intermediate transfer medium. The cleaner is the cleaner mentioned above in Embodiment A, B or C (such as the belt cleaner 100). In this image forming apparatus, toner on the intermediate transfer medium can be satisfactorily removed because optimum voltages are set and applied to the cleaner.

Embodiment E

In the image forming apparatus mentioned above in Embodiment D, an elastic belt is used for the intermediate transfer medium. In this case, a toner image on the intermediate transfer medium can be satisfactorily transferred onto the recording medium even when the recording medium has rough surface, thereby making it possible to form images with good evenness.

Embodiment F

In the image forming apparatus mentioned above in Embodiment E, plural counter members (such as the counter rollers 13, 14 and 15) are provided so as to be opposed to the cleaning brush members, respectively, with the intermediate transfer medium therebetween while being independent of each other. In this image forming apparatus, occurrence of a problem which is caused by a cleaner using the same counter member for the cleaning brush members and in which the intermediate transfer medium cannot be satisfactorily cleaned due to a current flowing along the backside of the intermediate transfer medium can be prevented.

Embodiment G

The image forming apparatus of Embodiment G (such as the printer 61 illustrated in FIG. 16) includes an image bearing member (such as the photoreceptor 1); a toner image forming device (such as the combination of the charger, the optical writing unit 20, and the developing device 5) to form a toner image on the image bearing member; a transferring device (such as the transfer roller 59) to transfer the toner image onto a recording medium at a transfer position; a recording medium feeding member (such as the feeding belt 51) to feed the recording medium to the transfer position; and a cleaner (such as the belt cleaner 500) to remove residual toner on the recording medium feeding member. The cleaner is the cleaner mentioned above in Embodiment A, B or C. In this image forming apparatus, toner on the recording medium feeding member can be satisfactorily removed because optimum voltages are set and applied to the cleaner.

Embodiment H

The image forming apparatus of Embodiment H (such as the printer 62 illustrated in FIG. 17) includes an image bearing member (such as the photoreceptor drum 1); a toner image forming device (such as the combination of the charger 2, the optical writing unit 20 and the developing device 5) to form a toner image on the image bearing member; and a cleaner (such as the drum cleaner 4) to remove residual toner on the image bearing member. The cleaner is the cleaner mentioned above in Embodiment A, B or C. In this image forming apparatus, toner remaining on the image bearing member can be satisfactorily removed because optimum voltages are set and applied to the cleaner.

Embodiment I

In the image forming apparatus mentioned above in Embodiment D, E, F, G or H, the toner has a first shape factor SF-1 of from 100 to 180. In this case, high quality images can be produced.

Embodiment J

The voltage setting device of Embodiment J includes a voltage applicator including at least two voltage applying members (such as the cleaning brush rollers) which are contacted with an object (such as the image bearing member (e.g., the photoreceptor 1 and the intermediate transfer belt 8) and the recording medium feeding belt 51) and to which voltages are applied based on the setup voltage values stored in a memory (such as the memory 137); a current detector (such as the current detectors 130*b*-135*b*) to detect currents flowing through the contact portions of the at least two voltage applying members with the object; and a setup voltage changing device (such as the controller 136) to change the setup voltage values based on the amounts of the currents detected by the current detector. The setup voltage changing device changes the setup voltage values for all the cleaning brush members at the same time. Therefore, the setup voltage changing process can be completed in a short time As mentioned above, the cleaner of this disclosure can change the setup voltage values for plural cleaning brush members in a short time Additional modifications and variations of the present invention are possible in light of the above teachings. It is therefore to be understood that within the scope of the appended claims the invention may be practiced other than as specifically described herein.

What is claimed is:

1. An image forming apparatus comprising:

an image bearing member;

a toner image forming device to form a toner image on the image bearing member using a toner;

a transferring device to transfer the toner image on the image bearing member to either an intermediate transfer medium or a recording medium at a transfer position;

a recording medium feeding member to feed the recording medium to the transfer position;

a cleaner including at least two cleaning brush members to electrostatically remove residual toner particles after a transferring process or a non-transferred toner image from a surface of any of the image bearing member, the intermediate transfer medium, and a feeding belt;

a memory to store setup voltage values;

a voltage applicator to apply voltages to the cleaning brush members based on a voltage values stored in the memory;

a current detector to detect amounts of current flowing through contact portions of any of the image bearing member, the intermediate transfer medium, and the feeding belt with the cleaning brush members; and a setup voltage changing device to change the setup voltages based on the amounts of current detected by the current detector, the setup voltage changing device performing change of the setup voltage values for the cleaning brush members at a predetermined time and performing the setup voltage changing process for a first voltage for removing the non-transferred toner image prior to the setup voltage changing process for a second voltage for removing a residual toner particles.

2. The image forming apparatus according to claim 1, wherein the toner has a shape factor SF-1 of from 100 to 180.

3. The image forming apparatus according to claim 1, wherein the image forming apparatus has a full color image print mode and a monochrome image print mode, and the setup voltage changing device changes the setup voltages based on the amounts of current detected by the current detector and a target current that based on whether the image forming apparatus is in the full color image print mode or the monochrome image print mode.

4. The image forming apparatus according to claim 1, wherein the transferring device includes a primary transferring device to transfer the toner image on the image bearing member to the intermediate transfer medium; and a secondary transfer device to transfer the toner image on the intermediate transfer medium to the recording medium; and wherein the primary transferring device and the intermediate transfer medium are separated from the image bearing member.

5. The image forming apparatus according to claim 1, wherein the transferring device includes a primary transferring device to transfer the toner image on the image bearing member to the intermediate transfer medium; and a a secondary transfer device to transfer the toner image on the intermediate transfer medium to the recording medium by applying a secondary transfer voltage to the secondary transfer device at a secondary transfer portion; and wherein the secondary transfer voltage is applied when the setup voltage changing process is performed.

* * * * *